US010136499B2

(12) United States Patent
Kim et al.

(10) Patent No.: US 10,136,499 B2
(45) Date of Patent: Nov. 20, 2018

(54) LIGHT-EMITTING MODULE AND LIGHTING APPARATUS PROVIDED WITH SAME

(71) Applicant: LG INNOTEK CO., LTD., Seoul (KR)

(72) Inventors: Do Yub Kim, Seoul (KR); Eon Ho Son, Seoul (KR); Mi Na Shin, Seoul (KR); Young Joo Ahn, Seoul (KR); Kwang Jae Lee, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 15/547,952

(22) PCT Filed: Feb. 1, 2016

(86) PCT No.: PCT/KR2016/001082
§ 371 (c)(1),
(2) Date: Aug. 1, 2017

(87) PCT Pub. No.: WO2016/126066
PCT Pub. Date: Aug. 11, 2016

(65) Prior Publication Data

US 2018/0249549 A1 Aug. 30, 2018

(30) Foreign Application Priority Data

Feb. 2, 2015 (KR) ..... 10-2015-0015974

(51) Int. Cl.
*H05B 37/02* (2006.01)
*H05B 33/08* (2006.01)
(Continued)

(52) U.S. Cl.
CPC ..... *H05B 33/0866* (2013.01); *F21S 10/02* (2013.01); *H05B 33/0821* (2013.01); *F21Y 2115/10* (2016.08)

(58) Field of Classification Search
CPC . H05B 33/0866; H05B 33/0821; F21S 10/02; F21Y 2115/10
(Continued)

(56) References Cited

U.S. PATENT DOCUMENTS 6,508,564 B1 1/2003 Kuwabara et al.
2005/0135094 A1 6/2005 Lee et al.
(Continued)

FOREIGN PATENT DOCUMENTS

KR 2001-0051962 A 6/2001
KR 2001-0101910 A 11/2001
(Continued)

*Primary Examiner* — Don Le
(74) *Attorney, Agent, or Firm* — Birch, Stewart, Kolasch & Birch, LLP

(57) ABSTRACT

A lighting apparatus disclosed in an embodiment comprises: a circuit board; a light-emitting module arranged on the circuit board and comprising a light source part having first to third light source parts emitting red, green and blue light; a control unit for providing current control signals to the first to third light source parts; a driver for controlling the current in the first to third light source parts by means of the control unit; and a memory unit having compensation data storing input current strength values for the first to third light source parts so that same emit white light having a previously configured correlated color temperature (CCT). The first, second and third light source parts comprise a plurality of first, second and third light-emitting elements for emitting red, green and blue light. The control unit controls the current in the first to third light source parts by means of the input current strength value corresponding to the compensation data so as to control the white light discharged from the light-emitting module is emitted as white light meeting the CCT criterion.

20 Claims, 21 Drawing Sheets

(51) Int. Cl.
*F21S 10/02* (2006.01)
*F21Y 115/10* (2016.01)

(58) Field of Classification Search
USPC ..... 315/185 R
See application file for complete search history.

(56) References Cited

U.S. PATENT DOCUMENTS

| | | | | |
|---|---|---|---|---|
| 2010/0315012 | A1* | 12/2010 | Kim | F21K 9/00 315/185 R |
| 2011/0012533 | A1 | 1/2011 | Lee | |
| 2013/0077299 | A1* | 3/2013 | Hussell | H05B 37/02 362/231 |
| 2014/0225517 | A1 | 8/2014 | Nam et al. | |
| 2016/0044753 | A1* | 2/2016 | Lee | H05B 33/086 315/185 R |
| 2016/0149088 | A1* | 5/2016 | Yan | H01L 25/0753 257/48 |
| 2016/0254416 | A1* | 9/2016 | Cheng | H01L 33/26 257/89 |
| 2017/0122530 | A1* | 5/2017 | Shum | F21V 17/105 |
| 2018/0077783 | A1* | 3/2018 | Sooch | H05B 33/0863 |
| 2018/0132329 | A1* | 5/2018 | Yan | H01L 25/0753 |

FOREIGN PATENT DOCUMENTS

| | | | |
|---|---|---|---|
| KR | 10-2005-0062433 | A | 6/2005 |
| KR | 10-2012-0050781 | A | 5/2012 |
| KR | 10-2013-0027740 | A | 3/2013 |
| KR | 10-2014-0097284 | A | 8/2014 |
| KR | 10-2014-0101608 | A | 8/2014 |
| KR | 10-2015-0011191 | A | 1/2015 |
| WO | WO 2010/101336 | A1 | 9/2010 |

* cited by examiner

LIGHT-EMITTING MODULE AND LIGHTING APPARATUS PROVIDED WITH SAME

CROSS REFERENCE TO RELATED APPLICATIONS

This application is the National Phase of PCT International Application No. PCT/KR2016/001082, filed on Feb. 1, 2016, which claims priority under 35 U.S.C. 119(a) to Patent Application No. 10-2015-0015974, filed in the Republic of Korea on Feb. 2, 2015, all of which are hereby expressly incorporated by reference into the present application.

TECHNICAL FIELD

The present invention relates to a light-emitting module and a lighting apparatus provided with the same.

BACKGROUND ART

Light emitting devices, for example, light emitting diodes are a type of semiconductor devices that convert electrical energy into light and are being popularized as next-generation light sources in place of existing fluorescent and incandescent lamps.

Since light emitting diodes generate light by using semiconductor devices, the light emitting diodes consume very low power as compared with incandescent lamps that generate light by heating tungsten or fluorescent lamps that allow ultraviolet rays generated through a high pressure discharge to collide with a phosphor to generate light.

Also, since such a light emitting diode generates light by using a potential gap of a semiconductor device, it has a longer lifespan and faster response characteristics than those of the existing light sources and has an eco-friendly characteristic.

Thus, many studies are being in progress in order to replace the existing light sources with the light emitting diodes. Also, the light emitting diodes are being increasingly used according to the trend as light sources of a variety of lamps used in indoor and outdoor places and lighting devices such as liquid crystal display devices, scoreboards, and streetlamps.

DISCLOSURE OF THE INVENTION

Technical Problem

Embodiments provide a light-emitting module including a plurality of light emitting devices that emit light having colors different from each other.

Embodiments also provide a light-emitting module in which groups of light emitting devices are arranged based on heat generation characteristics of the light emitting devices.

Embodiments also provide a light-emitting module in which groups of light emitting devices that emit light having colors different from each other are arranged based on color and heat dissipation characteristics.

Embodiments provide a light-emitting module in which a plurality of first to third light emitting devices that emit light having colors different from each other are disposed in a region of a reflection member on a circuit board.

Embodiments also provide a lighting apparatus that compensates white light emitted when a light-emitting module is initially driven with an input current strength value corresponding to while light having a preset CCT.

Embodiments also provide a lighting apparatus that previously compensates a difference between chromaticity coordinates of white light emitted from red, green, blue light sources and chromaticity coordinates of white light that is a reference for each preset CCT to adjust input current strength values of red, green, and blue light sources.

Embodiments provide a lighting apparatus including a control unit that controls an input current strength value so that white light emitted from a light-emitting module corresponds to white light having a preset CCT according to a temperature detected from the light-emitting module.

Embodiments also provide a light-emitting module capable of controlling a high color rendering property and a color and a lighting apparatus provided with the same.

Technical Solution

A lighting apparatus according to an embodiment includes: a light-emitting module including a circuit board and a light source part disposed on the circuit board and including first to third light source parts emitting red, green and blue light; a control unit providing first to third current control signals to control current of each of the first to third light source parts; a driver adjusting the current of the first to third light source parts through the first to third current control signals of the control unit; and a memory unit having compensation data in which input current strength values for the first to third light source parts are stored so that white light having a preset correlated color temperature (CCT) is emitted from the first to third light source parts, wherein the first light source part includes a plurality of first light emitting devices emitting red light, the second light source part includes a plurality of second light emitting devices emitting green light, the third light source part includes a plurality of third light emitting devices emitting blue light, and the control unit controls the current of the first to third light source parts through the input current strength values corresponding to the compensation data to control the light-emitting module so that the white light emitted from the light-emitting module is emitted as white light that becomes a reference for each CCT.

Advantageous Effects

In the embodiments, the light-emitting module may be improved in color uniformity.

In the embodiments, the light emitting devices within the light-emitting module may be arranged according to the heat generation characteristics to improve the heat dissipation efficiency of the light-emitting module.

In the embodiments, the light emitting devices emitting the colors different from each other may be arranged based on the heat generation to minimize the size of the circuit board.

In the embodiments, the color deviation of the preset CCT may be reduced in the lighting apparatus.

In the embodiments, the light-emitting module and the lighting apparatus provided with the same may be improved in reliability.

MODE FOR CARRYING OUT THE INVENTION

Figure 1:
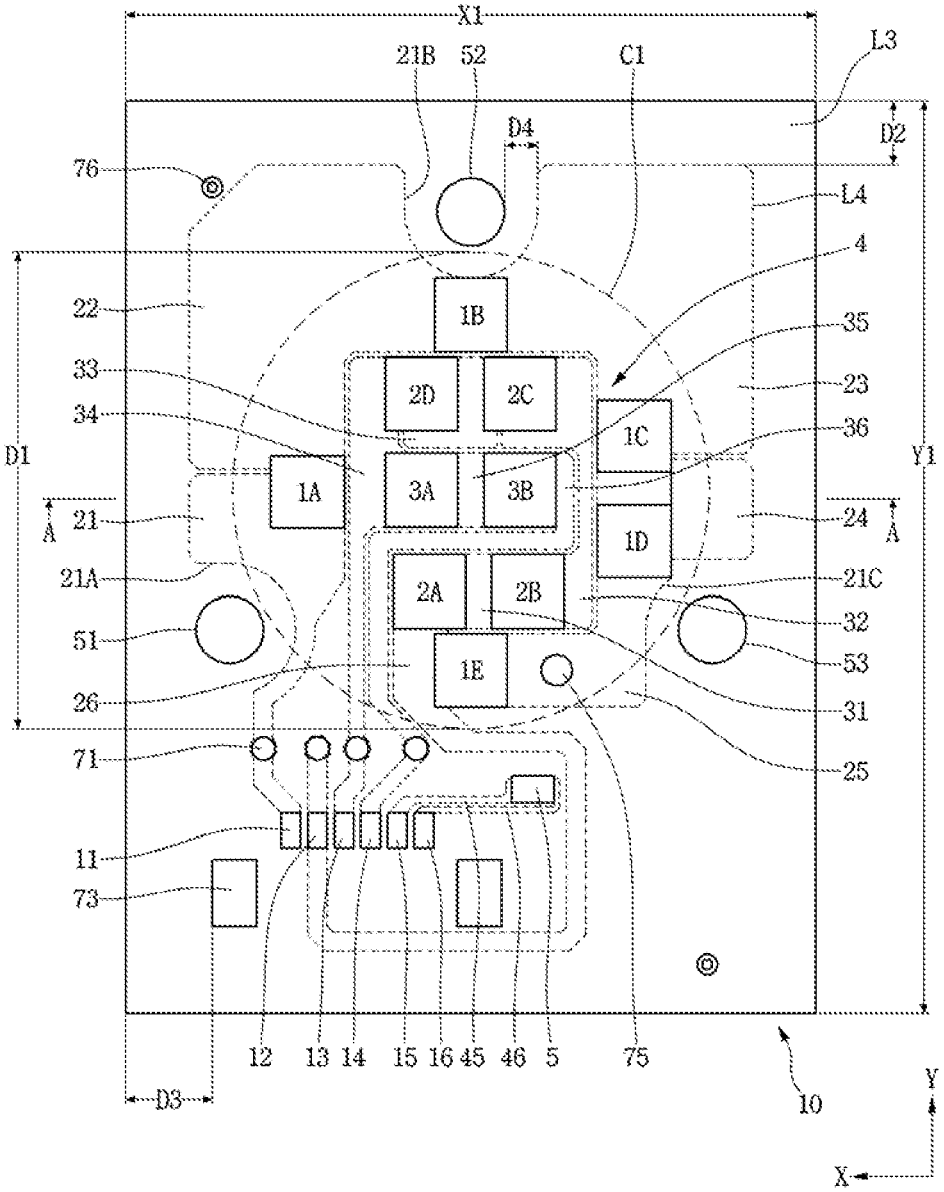
FIG. 1 is a plan view of a light-emitting module according to a first embodiment.

Hereinafter, exemplarily embodiments of the present invention will be described in detail with reference to the accompanying drawings in such a manner that the technical idea of the present invention may easily be carried out by a person with ordinary skill in the art to which the invention pertains. The present invention may, however, be embodied in different forms and should not be construed as limited to the embodiments set forth herein.

In the entire specification, when it is described that one comprises (or includes or has) some elements, it should be understood that it may comprise (or include or has) only those elements, or it may comprise (or include or have) other elements as well as those elements if there is no specific limitation. It will be understood that when a layer, a film, a region, or a plate is referred to as being 'on' another layer, film, region, or plate, it can be directly on the other layer, region, or plate, or intervening layers, films, regions, or plates may also be present. On the other hand, it will also be understood that when a layer, a film, an area or a plate is referred to as being "directly on" another one, intervening layers, films, areas, and plates may not be present. In the drawings, anything unnecessary for describing the present invention will be omitted for clarity, and also like reference numerals in the drawings denote like elements.

<Light-Emitting Module>

Hereinafter, a light-emitting module according to a first embodiment of the present invention will be described with reference to FIGS. 1 to 7.

Figure 2:
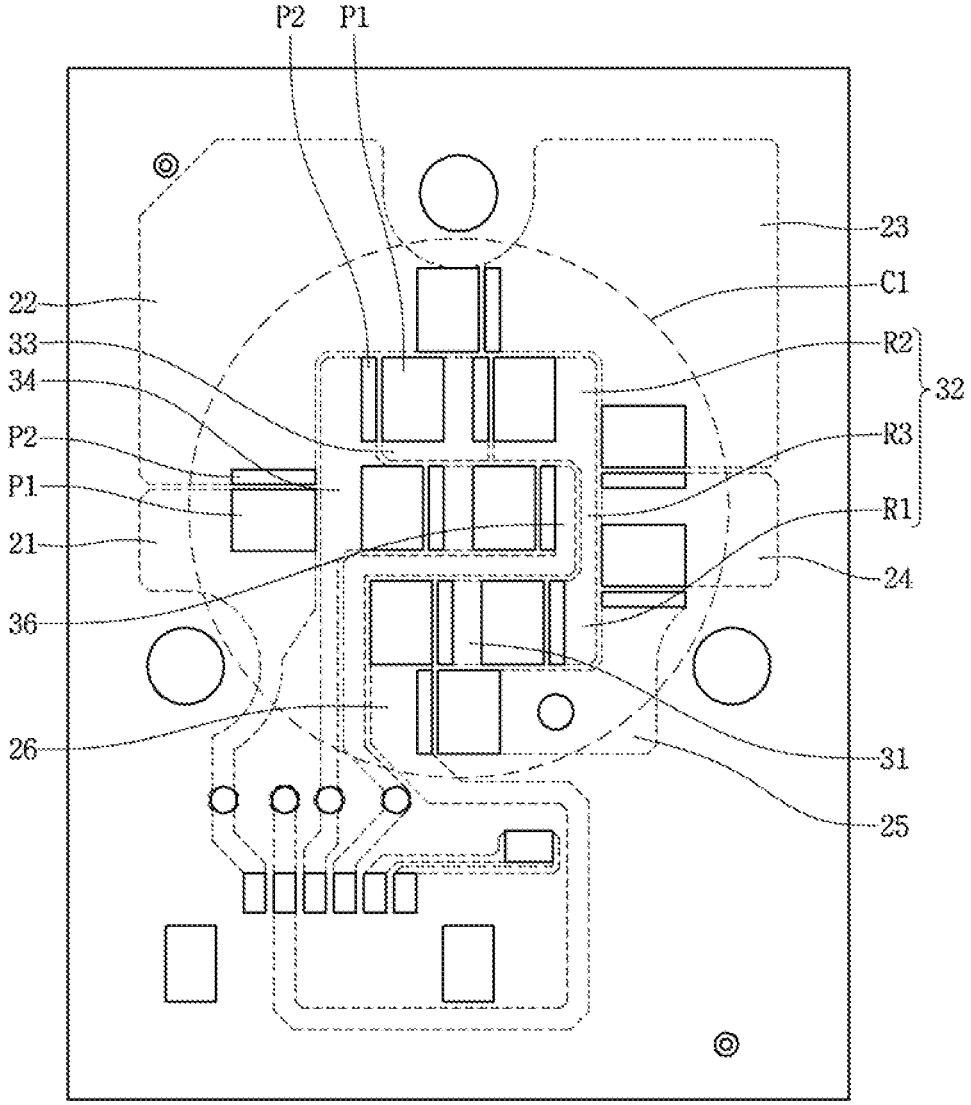
FIG. 2 is a plan view illustrating a circuit board of the light-emitting module of FIG. 1.
Figure 3:
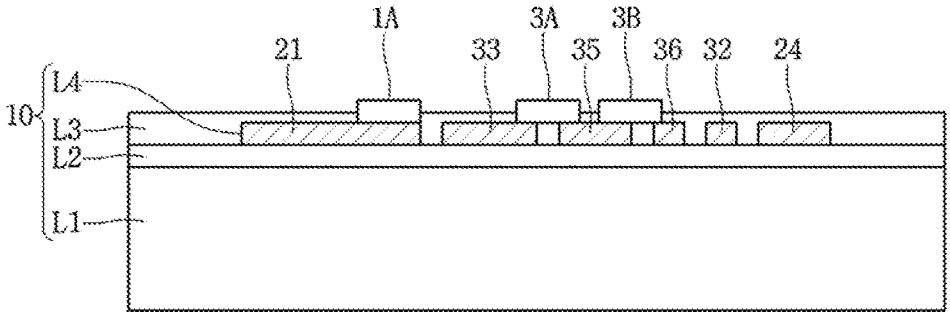
FIG. 3 is a cross-sectional view taken along line A-A of FIG. 1.
Figure 4:
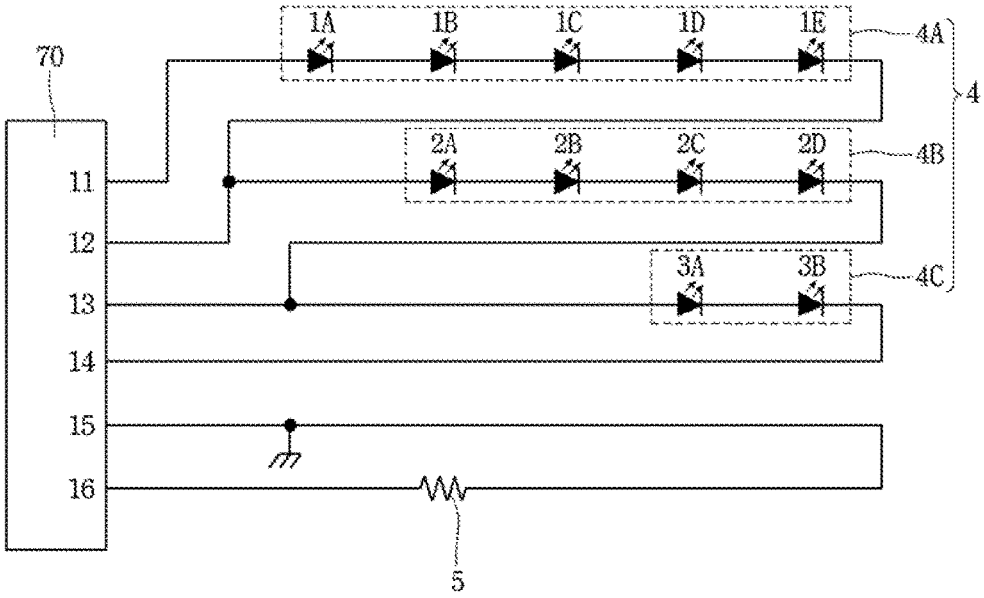
FIG. 4 is a circuit diagram of the light-emitting module of FIG. 1.
Figure 5:
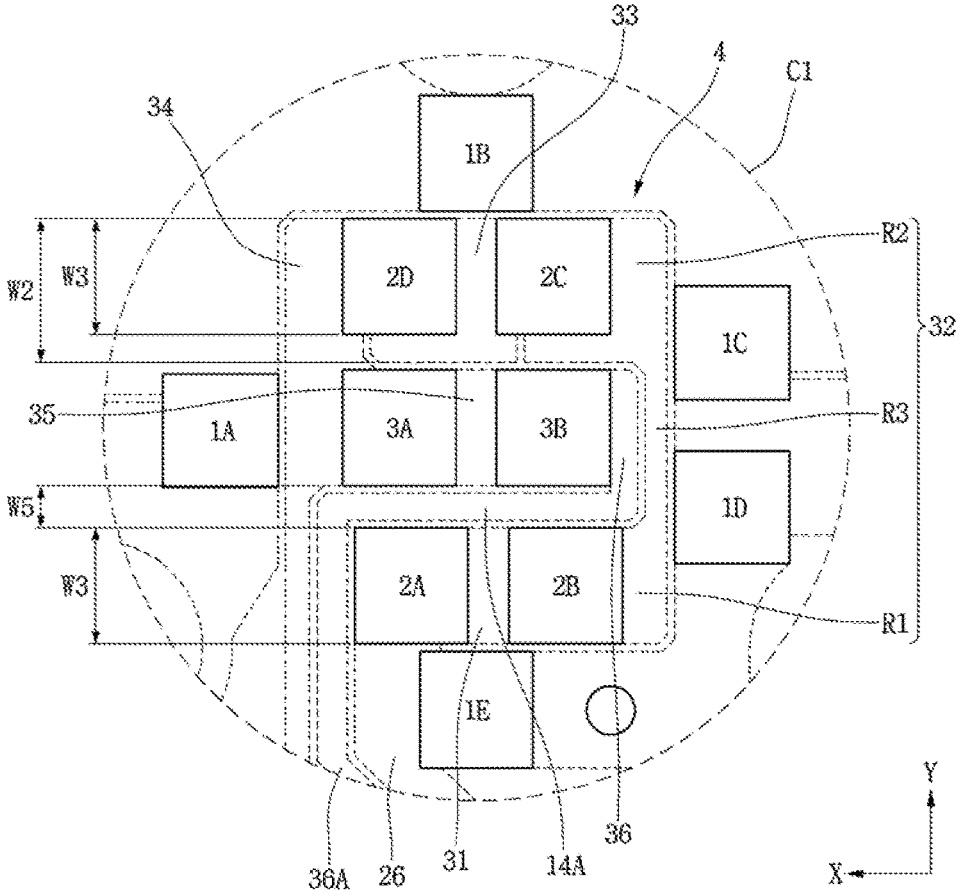
FIG. 5 is a view illustrating an example in which the light emitting devices are arranged in the light-emitting module of FIG. 1.
Figure 6:
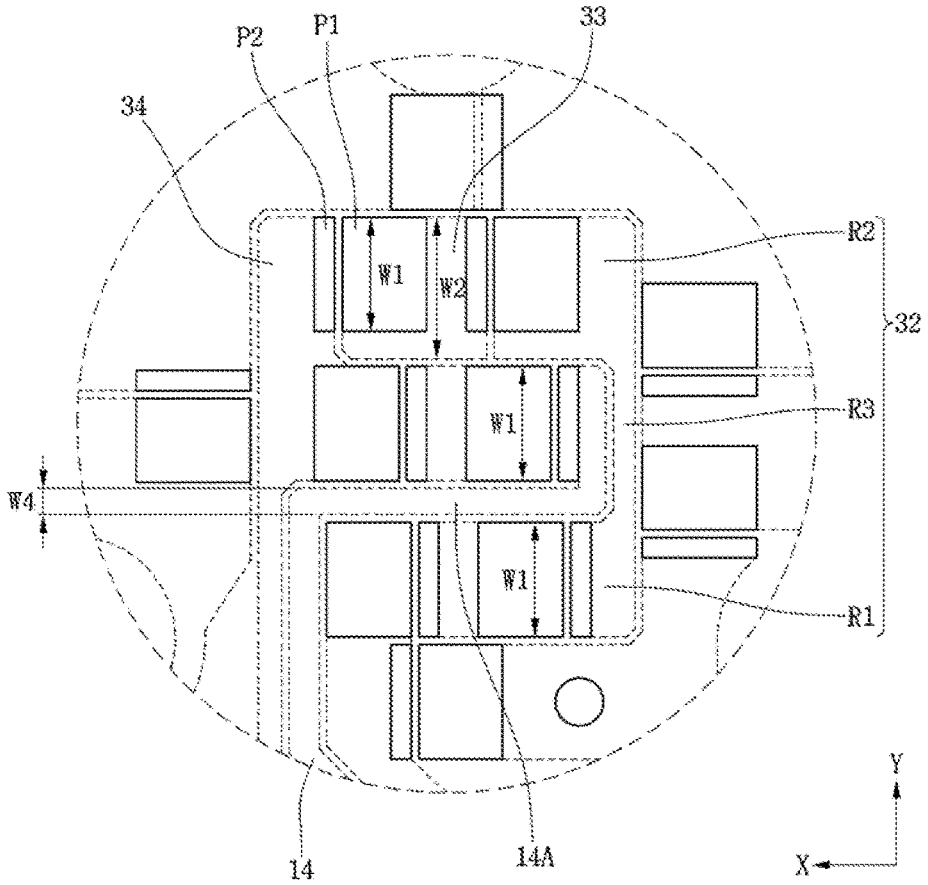
FIG. 6 is a view comparing widths of the light emitting device and a wiring in the light-emitting module of FIG. 1.
Figure 7:
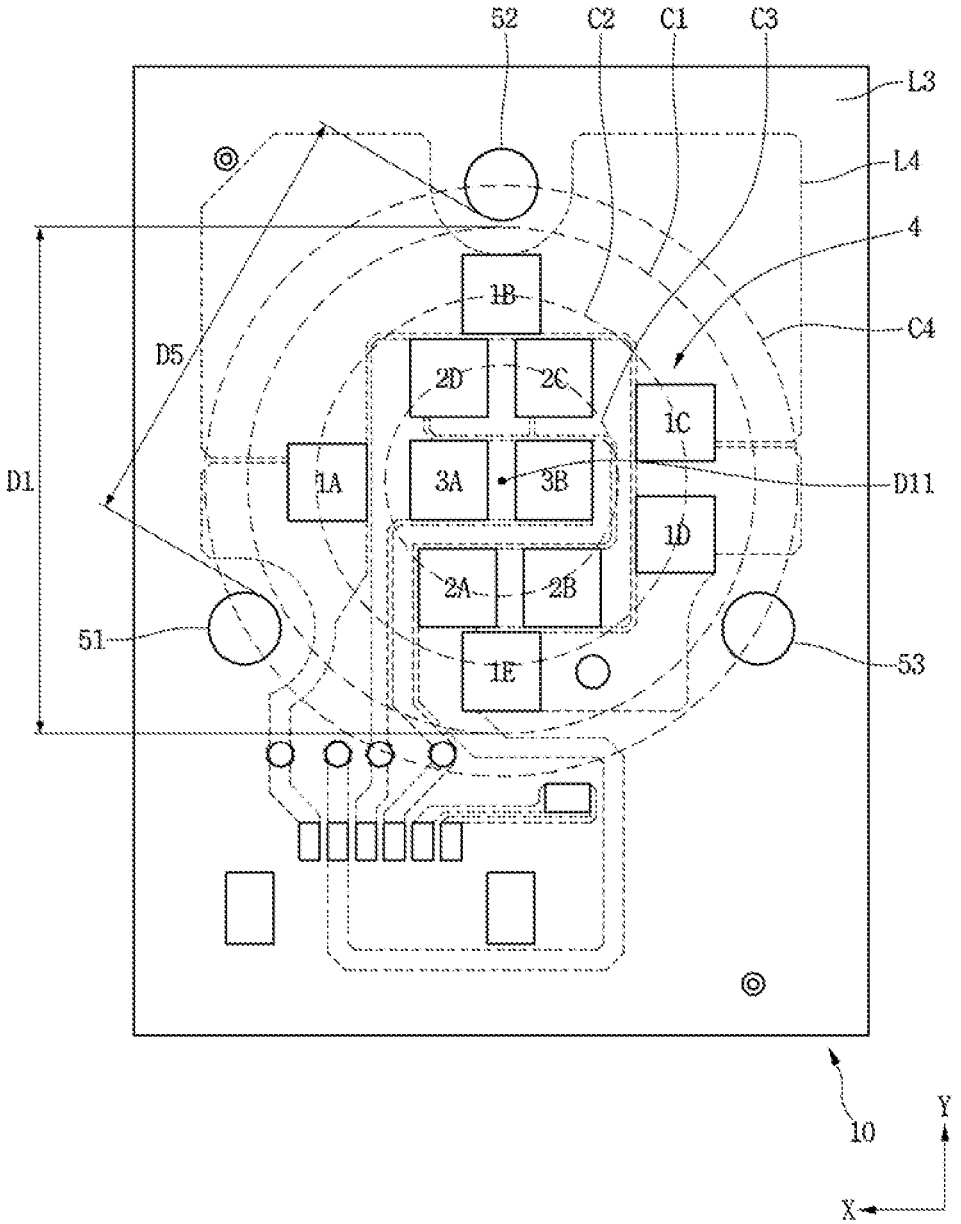
FIG. 7 is a view for explaining an arrangement of the light emitting devices in the light-emitting module of FIG. 1.

FIG. 1 is a plan view of a light-emitting module according to a first embodiment, FIG. 2 is a plan view illustrating a circuit board of the light-emitting module of FIG. 1, FIG. 3 is a cross-sectional view taken along line A-A of FIG. 1, FIG. 4 is a circuit diagram of the light-emitting module of FIG. 1, FIG. 5 is a view illustrating an example in which the light emitting devices are arranged in the light-emitting module of FIG. 1, FIG. 6 is a view comparing widths of the light emitting device and a wiring in the light-emitting module of FIG. 1, and FIG. 7 is a view for explaining an arrangement of the light emitting devices in the light-emitting module of FIG. 1.

Referring to FIGS. 1 to 7, a light-emitting module includes a circuit board 10 and a light source part 4 disposed on the circuit board 10 to emit light.

As illustrated in FIG. 1, the light source part 4 may include a plurality of light emitting devices 1A to 1E emitting light having a first color, a plurality of second light emitting devices 2A to 2D emitting light having a second color, and a plurality of third light emitting devices 3A and 3B emitting light having a third color.

The first light emitting devices 1A to 1E, the second light emitting devices 2A to 2D, and the third light emitting device 3A and 3B may be disposed in different numbers.

The first light emitting devices 1A to 1E may be disposed outside the second and third light emitting devices 2A to 2D, 3A, and 3D and disposed in number greater than the number of second and third light emitting devices 2A to 2D, 3A, and 3D.

The first light emitting devices 1A to 1E may be devices having heat generation characteristics greater than those of the second and third light emitting devices 2A to 2D, 3A, and 3B, and the second light emitting devices 2A to 2D may be devices having heat generation characteristics equal to or greater than those of the third light emitting devices 3A and 3B.

Each of the first light emitting devices 1A to 1E emits light having a wavelength that is longer than a peak wavelength of each of the second and third light emitting devices 2A to 2D, 3A, and 3B. Each of the second light emitting devices 2A to 2D emits light having a wavelength that is longer than a peak wavelength of each of the third light emitting devices 3A and 3B. The first to third light emitting devices 1A to 1E, 2A to 2D, 3A, and 3B may be arranged in a larger number as the wavelength of the light is longer, or may be arranged in a smaller number as the wavelength of the light is shorter.

The first light emitting devices 1A to 1E may be red light emitting devices that emit red light in a visible spectrum and also may emit light having a peak wavelength between 614 nm to 620 nm.

The second emitting devices 2A to 2D may be green light emitting devices that emit green light in the visible spectrum and also may emit light having a peak wavelength between 540 nm to 550 nm.

The third emitting devices 3A and 3B may be blue light emitting devices that emit blue light in the visible spectrum and also may emit light having a peak wavelength Wp between 455 nm to 470 nm.

Since the first light emitting devices 1A to 1E emit the red light, the second light emitting devices 2A to 2D emit the green light, and the third light emitting devices 3A and 3B emit the blue light, light emitted from the light source part 4 may be white light.

As illustrated in FIG. 4, in the light-emitting module, the plurality of first light emitting devices 1A to 1E that are connected to each other in series may be arranged, and input sides of the plurality of second light emitting devices 2A to 2D that are connected to each other in series may be connected to output sides of the plurality of first light emitting devices 1A to 1E. Also, input sides of the plurality of third light emitting devices 3A and 3B that are connected to each other in series may be connected to output sides of the plurality of second light emitting devices 2A to 2D.

Each of the light emitting devices 1A to 1E, 2A to 2D, 3A, and 3B may be a package or chip of a light emitting diode (LED).

The circuit board 10 may be made of at least one of a resin-based PCB, a metal core PCB (MCPCB), a flexible PCB (FPCB). The circuit board 10 may have a length X1 in a first direction X, which is longer than that Y1 in a second direction Y. The length X1 in the first direction X may be defined as a width.

As illustrated in FIGS. 2 and 3, the circuit board 10 may include a metal layer L1 for heat dissipation, an insulation layer L2 for insulation with the metal layer L1, a protection layer L3 disposed on the insulation layer L2, and a wiring layer L4. The wiring layer L4 is selectively connected to the light source part 4.

The metal layer L1 of the circuit board 10 may have a thickness corresponding to 60% or more of that of the circuit board 10 and made of copper, aluminum, silver, gold, or an alloy including at least one of the above-described materials. The metal layer L1 may have a thickness of about 300 μm or more, e.g., about 500 μm or more.

The insulation layer L2 may insulate the metal layer L1 from the wiring layer L4 and include an epoxy-based or poly imide-based resin. Also, a solid component, e.g., a filler or a glass fiber may be dispersed in the insulation layer L2, or the insulation layer L2 may be made of an inorganic material such as oxide or nitride. The insulation layer L2 may, for example, include a material such as $SiO_2$, $TiO_2$, $SiO_x$, $SiO_xN_y$, $Si_3N_4$, and $Al_2O_3$. The insulation layer L2 may have a thickness ranging from 5 μm to 7 μm.

The wiring layer L4 may be etched into a preset circuit pattern, and portions of a top surface of the circuit pattern may function as pads P1 and P2 by being exposed through the protection layer L3. The wiring layer L4 may be made of copper or an alloy including copper. The surface of the wiring layer L3 may be surface-treated by using nickel, silver, gold, palladium, or an alloy including at least one of the above-described materials. The wiring layer L3 has a thickness of 100 μm or more. The wiring layer L3 may be connected to the light emitting devices 1A to 1E, 2A to 2D, 3A and 3B through the plurality of pads P1 and P2.

The protection layer L3 is a layer for protecting the wiring layer L4. The protection layer L3 may be a layer for preventing exposure of an area except for the pads and made of an insulation material, e.g., solder resist. The protection layer L3 may have a white color and improve light reflection efficiency. The protection layer L3 may allow the pads P1 and P2 to be opened. The opened area may have a shape selected from a circular shape, a hemispherical shape, a polygonal shape, and an irregular shape, but is not limited thereto.

As illustrated in FIGS. 1 and 2, the wiring layer L3 of the circuit board 10 includes first wiring portions 21 to 26 connecting the plurality of first light emitting devices 1A to 1E to each other, second wiring portions 31 to 34 connecting the plurality of second light emitting devices 2A to 2D to each other, and third wiring portions 35 and 36 connecting the plurality of third light emitting devices 3A and 3B to each other.

The first wiring portions 21 to 26 may be disposed outside the second wiring portions 31 and 34 and the third wiring portions 35 and 36. The first wiring portions 21 to 26 may be disposed outside the second and third light emitting devices 2A to 2D, 3A and 3B. Wirings of the first wiring portions 21 to 26 may be spaced apart from each other to connect the plurality of first light emitting devices 1A to 1E to each other.

The first wiring portions 21 to 26 connect the first light emitting devices 1A to 1E to each other in series. The plurality of second light emitting devices 2A to 2D may be disposed inside the first wiring portions 21 to 26 and connected to each other in series by the second wiring portions 31 to 34. The plurality of third light emitting devices 3A and 3B may be disposed between the plurality of first light emitting devices 1A to 1E and connected to each other in series by the third wiring portions 35 and 36.

The first wiring portions 21 to 26 include a plurality of wirings, e.g., first to sixth wirings 21, 22, 23, 24, and 25. For example, the first wiring portions 21 to 26 may be disposed in number of one more than that of first light emitting devices 1A to 1E.

Each of the wirings 21, 22, 23, 24, and 25 of the first wiring portions 21 to 26 may have a surface area of a top surface, which is greater than that of a top surface of each of the second and third wiring portions 31 to 34, 35, and 36.

Both ends of each of the first wiring portions 21 to 26 are connected to first and second connection terminals 11 and 12 through the wirings. For example, the first and sixth wirings 21 and 26 of the first wiring portions 21 to 26 are connected to a connector (see reference numeral 90 of FIG. 4) through the first and second connection terminals 11 and 12. Each of the first and sixth wirings 21 and 26 may have a surface area less than that of each of the second to fourth wirings 22, 23, 24, and 25. Thus, each of the second to fourth wirings 22, 23, 24, and 25 may have a surface area greater than that of each of the first and sixth wirings 21 and 26 to prevent heat generated from the light source part 4 from being concentrated.

Since each of the second to fourth wirings 22, 23, 24, and 25 of the first wiring portions 21 to 26 which do not include the first and second connection terminals 11 12 has a top surface area greater than that of each of the first and sixth wirings 21 and 26, the first light emitting devices 1A to 1E may be improved in heat dissipation efficiency, and thus, the first light emitting devices 1A to 1E may be improved in operation reliability.

Also, each of the second and third wirings 22 and 23 disposed at an opposite side of the connection terminals 11 to 16 on the board 10 may have a surface area or a top surface area greater than that of each of other wirings 21, 24, 25, and 26. Thus, heat generated from the first, second, and third devices 1A, 1B, and 1C disposed on an area, into which heat is concentrated, of the plurality of first light emitting devices 1A to 1E connected to the second and third wirings 22 and 23 may be effectively released.

The first to sixth wirings 21 to 26 include the pads P1 and P2 disposed under the first light emitting devices 1A to 1E. For example, the pads P1 and P2 of the first to sixth wirings 21 to 26 are electrically connected to each of the first light emitting devices 1A to 1E. The pads P1 and P2 may be areas defined by removing the protection layer L3.

The plurality of first light emitting devices 1A to 1E may be respectively disposed at sides opposite to each other with respect to the areas of the second light emitting devices 2A to 2D and the third light emitting devices 3A and 3B. For example, the first device 1A and the third and fourth devices 1C and 1D of the plurality of first light emitting devices 1A to 1E may be disposed at sides opposite to each other, and the second device 1B and the fifth device 1E may be disposed at sides opposite to each other. Alternatively, at least two of the plurality of first light emitting devices 1A to 1E may be disposed at positions that are symmetrical to each other. For example, the second device 1B and the fifth device 1E may be disposed at positions that are symmetrical to each other.

The second wiring portions 31 to 34 include seventh to tenth wirings 31, 32, 33, and 34. The second wiring portions 31 to 34 include a seventh wiring 31 connected to an output side of the first wiring portions 21 to 26, e.g., a sixth wiring 26, an eighth wiring 32 adjacent to the seventh wiring 31, a ninth wiring 33 adjacent to the eighth wiring 32, and a tenth wiring 34 adjacent to the ninth wiring 33.

Output sides of the first wiring portions 21 to 26 may be input sides of the second wiring portions 31 to 34. For example, the sixth wiring 26 of the first wiring portions 21 to 26 may be an input-side wiring of the second wiring portions 31 to 34. The second wiring portions 31 and 34 connect the first to fourth devices 2A, 2B, 2C, and 2D of the second light emitting devices 2A to 2D to each other.

Output sides of the second wiring portions 31 to 34 may be connected to input sides of the third wiring portions 35 to 36. For example, the output-side tenth wiring 34 of the second wiring portions 31 to 34 may be an input-side wiring of the third wiring portions 35 and 36. The third wiring portions 31 and 34 connect the first and second devices 3A and 3B of the third light emitting devices 3A and 3B.

As illustrated in FIG. 4, the output sides of the plurality of first light emitting devices 1A to 1E may be connected to the input sides of the plurality of light emitting devices 2A to 2D, and the output sides of the plurality of second light emitting devices 2A to 2D may be connected to the output sides of the plurality of third light emitting devices 3A and 3B.

At least two 2A and 2B of the second light emitting devices 2A to 2D may be disposed on an area between the sixth device 1E of the first light emitting devices 1A to 1E and the third light emitting devices 3A and 3B, and remaining at least two may be disposed on an area between the second device 1B of the first light emitting devices 1A to 1E and the third light emitting devices 3A and 3B.

A distance between the second and fifth devices 1B and 1E in the first light emitting devices 1A to 1E may be greater than that between the first device 1A and the third device 1C or the fourth device 1D.

The plurality of third light emitting devices 3A 3B may be disposed between the devices 1A, 1C, and 1D of the first light emitting devices 1A to 1E in the first direction X and disposed between the devices 2A, 2B, 2C, and 2D of the second light emitting devices 2A to 2D in the second direction Y. The first direction X may be a width direction of the board 10, and the second direction Y may be a longitudinal direction Y1 longer than the width direction X1 of the board 10.

In the plurality of first light emitting devices 1A to 1E, at least a pair of devices disposed at sides opposite to each other with respect to the areas of the second and third light emitting devices 2A to 2D and 3A and 3B may be disposed to face each other or correspond to each other.

In the plurality of second light emitting devices 2A to 2D, at least a pair of devices disposed at sides opposite to each other with respect to the areas of the third light emitting devices 3A and 3B may be disposed to face each other or correspond to each other.

The plurality of second light emitting devices 2A to 2D may be disposed in numbers less than that of first light emitting devices 1A to 1E and greater than that of third light emitting devices 3A and 3B. The second light emitting devices 2A to 2D may be disposed in numbers greater 150% or more, for example, greater 200% or more than that of third light emitting devices 3A and 3B. The third light emitting devices 3A and 3B may include at least two devices.

The first light emitting devices 1A to 1E may be disposed in numbers greater 125% or more than that of second light emitting devices 2A and 2D. Each of the first to third light emitting devices 1A to 1E, 2A to 2D, 3A, and 3B may be arranged in different numbers according to intensities of light thereof to improve brightness uniformity of emitted light on the board 10.

Each of the first wiring portions 21 to 26 connected to the first light emitting devices 1A to 1E has a surface area greater than that of each of the wirings of the second wiring portions 31 to 34 connected to the second light emitting devices 2A to 2D. Each of the second wiring portions 31 to 34 connected to the second light emitting devices 2A to 2D may have a surface area greater than that of each of the third wiring portions 35 and 36 connected to the third light emitting devices 3A and 3B. Thus, the first light emitting devices 1A to 1E having the highest heat generation characteristics may be disposed at the outermost side of the light source part 4 to effectively release heat emitted from the first light emitting devices 1A to 1E. The heat emitted from the first light emitting devices 1A to 1E may be prevented from being affected to the second and third light emitting devices 2A to 2D, 3A, and 3B.

As illustrated in FIGS. 1 and 2, a plurality of holes 51, 52, and 53 may be defined outside the first wiring portions 21 to 26, e.g., outside any wiring of the first to sixth wirings 21, 22, 23, 24, 25, and 26. The plurality of holes 51, 52, and 53 may include a first hole 51 defined outside 21A the first wiring 21, a second hole 52 defined outside 21B the second and third wirings 22 and 23, and a third hole 53 defined outside 21C the fourth and fifth wirings 24 and 25.

A straight-wiring connecting the first to third holes 51, 52, and 53 to each other may have a triangular shape. The plurality of holes 51, 52, and 53 may be defined outside the light source part 4 to support a lower portion of the reflection member that will be described later.

The pads P1 and P2 of the first to sixth wirings 21, 22, 23, 24, 25, and 26 may be disposed inside the first to third holes 51, 52, and 53. The light source part 4 may be disposed inside a first virtual circle C1 having a predetermined radius from any center on the circuit board 10. The first virtual circle C1 may have a diameter D1 of 19 mm or more, e.g., 22 mm or more. The diameter D1 may vary according to sizes and the number of the first to third light emitting devices 1A to 1E, 2A to 2D, 3A, and 3B of the light source part 4. The first virtual circle C1 may define an area of the light source part 4 and range from 19 mm to 30 mm, e.g., from 20 mm to 25 mm. The first virtual circle C1 may be defined around the light source part 4 to define a boundary of the reflection member. The first virtual circle C1 may have a diameter D1 may be set in consideration of brightness and luminous flux uniformity of light generated from the light source part 4.

The first to third wiring portions 21 to 26, 31 to 34, 35, and 36 may be selectively connected to the connection terminals 11, 12, 13, and 14. A test pad 71 may be exposed from each of the wirings adjacent to the connection terminals 11, 12, 13, and 14. An operation, current, and a voltage of each wiring may be tested through the test pad 71.

A recognition mark 76 may be disposed on the circuit board 10. The recognition mark 76 may be disposed outside the first virtual circle C1. The recognition mark 76 may be a mark for setting coordinates during the surface mounting SMT. The recognition mark 76 may be disposed outside the first wiring portions 21 to 26 on the circuit board 10.

A module temperature detection area 75 may be disposed on any wiring of the first wiring portions 21 to 26. The module temperature detection area 75 may be an area defined by exposing a portion of the wiring and disposed adjacent to any devices 1D and 1E of the third light emitting devices 3A and 3B. Thus, the module temperature detection area 75 may be disposed adjacent to any devices 1D and 1E of the third light emitting devices 3A and 3B, which is most-sensitive to a temperature, to provide a module temperature.

A heat detection device 5 may be disposed on the circuit board 10. The heat detection device 5 may be disposed on an area adjacent to any device of the first light emitting devices 1A to 1E, e.g., the sixth device 1E. The heat detection device 5 may be disposed adjacent to anyone device 1E of the first light emitting devices 1A to 1E, which has the highest heat generation characteristic, of the first to third light emitting devices 1A to 1E, 2A to 2D, 3A, and 3B.

The heat detection device 5 may be connected to the connection terminals 15 and 16 through the fourth wiring portions 45 and 46. The heat detection device 5 may be a thermistor that is a variable resistor having a resistance value, which is variable according to a temperature. The heat detection device 5 may be a negative temperature coefficient (NTC) that is reduced in specific resistance according to an increase of the temperature. For another example, the heat detection device 5 may be a positive temperature coefficient (PTC).

A connector 70 may be disposed on the connection terminals 11 to 16 and an external connection terminal 73. The connector 70 may selectively supply power to the connection terminals 11 to 14 to turn the first to third light emitting devices 1A to 1E, 2A to 2D, 3A, and 3B on/off.

As illustrated in FIG. 4, the first to third light emitting devices 1A to 1E, 2A to 2D, 3A, and 3B may be selectively driven or turned on/off at the same time, but is not limited thereto. The light source part 4 may include a group of the plurality of first light emitting devices 1A to 1E as a first light source part 4A, a group of the plurality of second light emitting devices 2A to 2D as a second light source part 4B, and a group of the plurality of third light emitting devices 3A and 3B as a third light source part 4C. The first to third light source parts 4A, 4B, and 4C may be individually driven.

In the circuit board 10, a distance D4 between each of the holes 51, 52, and 53 and a wiring layer L4 may be 1.2 mm or more, e.g., 1.5 mm or more. The distance D4 may prevent electrical interference with the wiring layer L4 from occurring.

In the circuit board 10, the first wiring portions 21 to 26 may be spaced a predetermined distance D2 from an edge of the circuit board 10, and the distance D2 may be spaced a distance of 2.5 mm or more, e.g., a distance 3 mm or more from the edge of the circuit board 10. When the distance D2 is too small, leakage current may occur through the edge of the circuit board 10.

The external connection terminal 73 may be spaced a predetermined distance D3 from the edge of the circuit board 10. The distance D3 may be greater than the distance D2. The distance D3 may be 3.5 mm, e.g., 4 mm or more. The distance D3 may vary according to a supplied voltage.

Referring to FIGS. 5 and 6, the seventh wiring 31 of the second wiring portions 31 to 34 may have a width W3 less than that W2 of the ninth wiring 33. A distance W5 between each of the first and second devices 2A and 2B of the second light emitting devices 2A to 2D and each of the third light emitting devices 3A and 3B may be equal to that between each of the third and fourth devices 2C and 2D of the second light emitting devices 2A to 2D and each of the third light emitting devices 3A and 3B. Although the width W1 of the seventh wiring 31 and the width W2 of the ninth wiring 33 are different from each other, the distance W5 between the second and third light emitting devices 3A and 3B may be equally provided. Thus, the width W4 by a connection wiring 14A between the seventh wiring 31 of the second wiring portions 31 to 34 and each of the third wiring portions 35 and 36 may be compensated with the width W2 of the ninth wiring 33 of the second wiring portions 31 to 34.

The widths W1 of the pads P1 and P2 of the seventh and ninth wirings 31 and 33 may be the same, but is not limited thereto. The widths W1 of the pads P1 and P2 of the seventh and ninth wirings 31 and 33 may be the same as that (e.g., W1) in the second direction of the second light emitting devices 2A to 2D, but is not limited thereto.

The width W2 of the ninth wiring 33 may be greater than that W1 of each of the pads P1 and P2 of the ninth wiring 33.

The eighth wiring 32 of the second wiring portions 31 to 34 may include a first area R1 adjacent to the seventh wiring 31, a second area R2 adjacent to the ninth wiring 33, and a third area R3 that is branched to a area between each of the third and fourth devices 1C and 1D of the first light emitting devices 1A to 1E and the second device 3B of the third light emitting devices 3A and 3B. A width of the first area R1 may be the width W1 of the seventh wiring 31, a width of the third area R3 may be the width W2 of the ninth wiring 33 and greater than that of the first area R1. A width of the second area R2 of the eighth wiring 32 may be greater than that (e.g., the width W1) in the second direction of the second light emitting devices 2A to 2D.

As described above, since the third light emitting devices 3A and 3B has the same distance W5 as the first and second devices 2A and 2B of the second light emitting devices 2A to 2D and the third and fourth devices 2C and 2D, brightness uniformity between the devices may be provided.

The third wiring portions 35 to 36 connect the third light emitting devices 3A and 3B to each other in series. A wiring width of each of the third wiring portions 35 and 36 may be equal to a device width of each of the third light emitting devices 3A and 3B.

Referring to FIG. 7, an outer boundary wiring of the light source part 4 may be defined by the first virtual circle C1 on the circuit board 10. The first virtual circle C1 may have a diameter less than that of a virtual circle C4 passing through the plurality of holes 51, 52, and 53 and have a diameter greater than that of a second virtual circle C2 passing through the plurality of first light emitting devices 1A to 1E. The first virtual circle C1 may have a predetermined radius by using an area between the plurality of third light emitting devices 3A and 3B as a center D11.

The plurality of first light emitting devices 1A to 1E may be arranged along the inside of the first virtual circle C1. The first virtual circle C1 may be disposed outside the plurality of first to third light emitting devices 1A to 1E, 2A to 2D, 3A, and 3B. The plurality of first light emitting devices 1A to 1E may be disposed more adjacent to the first virtual circle C1 than the plurality of second and third light emitting devices 2A to 2D, 3A, and 3B.

The second virtual circle C2 may be a circle passing through the plurality of first light emitting devices 1A to 1E and disposed outside the plurality of second light emitting devices 2A to 2D. The third virtual circle C3 may be a circle passing through the plurality of second light emitting devices 2A to 2D and disposed inside the plurality of first light emitting devices 1A to 1E and outside the third light emitting devices 3A and 3B. The centers D11 of the first to third virtual circles C1, C2, and C3 may be areas between the plurality of third light emitting devices 3A and 3B.

The first virtual circle C1 may have a diameter D1 less than a distance D5 between the first to third holes. Here, the diameter D1 may vary according to the number of holes 51 to 53. The second virtual circle C2 passing through the plurality of first light emitting devices 1A to 1E may be disposed inside the first to third holes 51, 52, and 53. Thus, the light source part 4 may be disposed at the optimal position in consideration of heat characteristics. The light source part 4 may be disposed within the first virtual circle C1.

Figure 8:
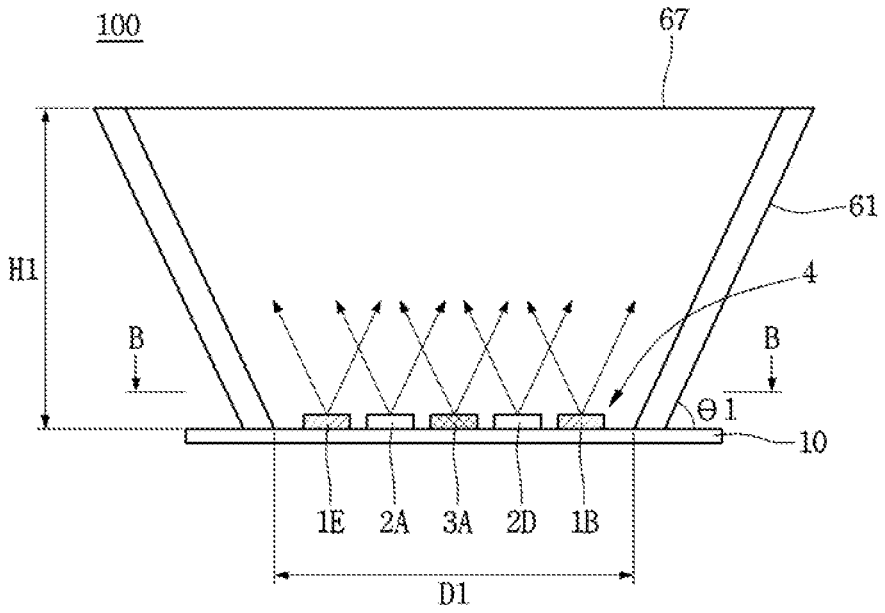
FIG. 8 is a side cross-sectional view of a light-emitting module according to a second embodiment.
Figure 9:
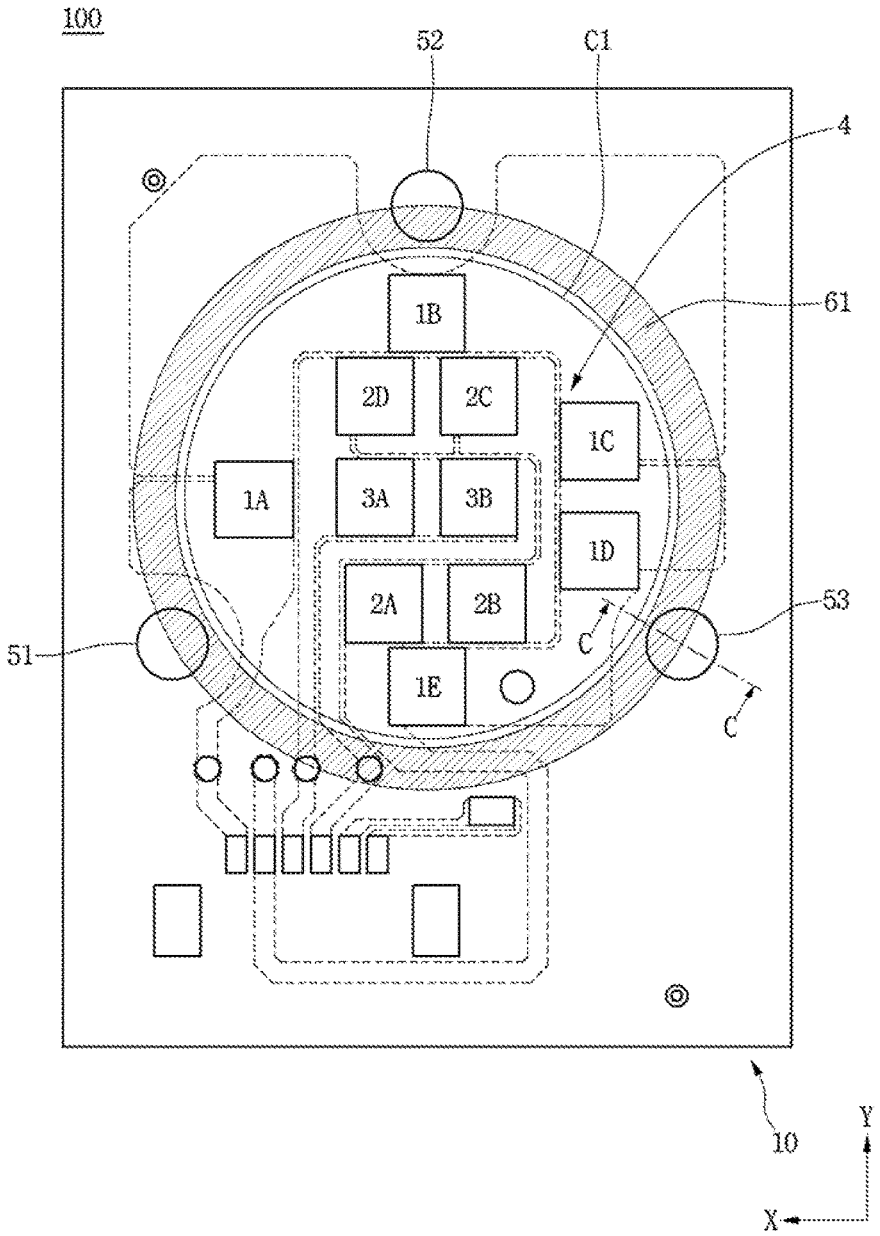
FIG. 9 is a cross-sectional view taken along line B-B in the light-emitting module of FIG. 8.
Figure 10:
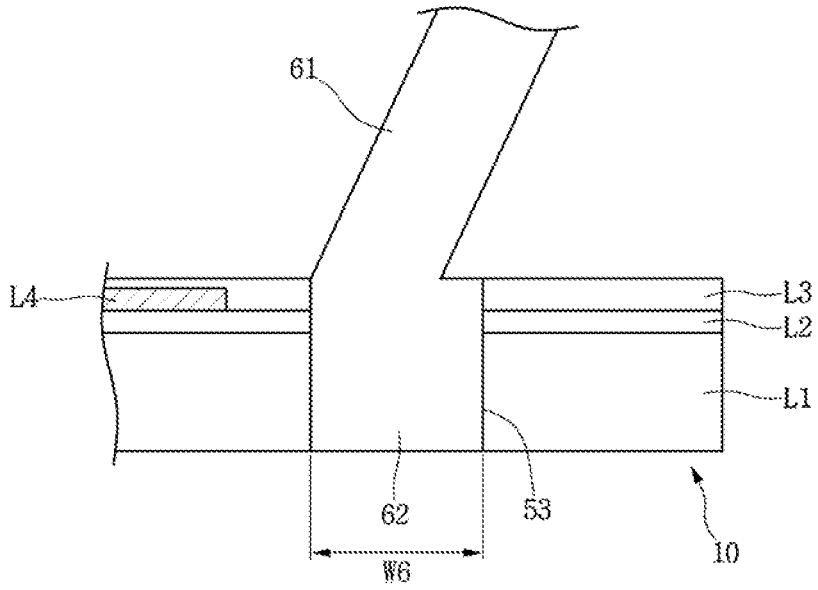
FIG. 10 is a cross-sectional view taken along line C-C in the light-emitting module of FIG. 9.

FIG. 8 is a side cross-sectional view of a light-emitting module according to a second embodiment, FIG. 9 is a cross-sectional view taken along line B-B in the light-emitting module of FIG. 8, and FIG. 10 is a cross-sectional view taken along line C-C in the light-emitting module of FIG. 9.

Referring to FIGS. 8 to 10, a light-emitting module 100 includes a light source part 4 including a plurality of first to third light emitting devices 1A to 1E, 2A to 2D, 3A, and 3B according to another embodiment on a circuit board 10 and a reflection member 61 disposed to surround the light source part 4.

The light-emitting module 100 includes the light source part 4 including the first to third light emitting devices 1A to 1E, 2A to 2D, 3A, and 3B on the circuit board 10 according to the foregoing embodiment. This configuration will be described with reference to the description according to the first embodiment.

The reflection member 61 may be attached to the circuit board 10. The reflection member 61 surrounds the light source part 4 including the first to third light emitting devices 1A to 1E, 2A to 2D, 3A, and 3B according to an embodiment to reflect emitted light.

The reflection member 61 may have a reflection surface that reflects light emitted from the first to third light emitting devices 1A to 1E, 2A to 2D, 3A, and 3B. The reflection member 61 may be substantially perpendicular to the circuit board 10 or may have an acute angle with respect to a top surface of the circuit board 10. The reflection surface may coat with a material that is capable of easily reflecting light or be deposited by using the material.

The first light emitting devices 1A to 1E may be disposed more adjacent to the reflection member 61 than the second and third light emitting devices 2A to 2D, 3A, and 3B.

The reflection member 61 may include a resin material or a metal material. The resin material includes a plastic material and a resin material such as silicon or epoxy. The reflection member 61 may include the resin material such as silicon or epoxy, and metal oxide may be added to the reflection member 61. The metal oxide may be a material having a refractive index greater than that of a molding member, e.g., include $TiO_2$, $Al_2O_3$, or $SiO_2$. 5 wt % or more of the metal oxide may be added to the reflection member to cause reflectivity corresponding to 50% or more, e.g., 78% or more with respect to incident light.

When the reflection member 61 is made of the metal material, the reflection member 61 may be spaced apart from the first to third wiring portions 35 and 36 of the circuit board 10 and may include at least one of aluminum (Al), silver (Ag), an aluminum alloy, or a silver alloy.

The reflection member 61 may be disposed at a height H1 corresponding to a height at which light emitted from the light source part 4 is capable of being mixed, but is not limited thereto.

The height H1 of the reflection member 61 may be greater than the diameter D1 of the first virtual circle C1, which is illustrated in FIGS. 1 and 9, or the diameter of the reflection member 61 to minimize a difference in color sense. The reflection member 61 may have the height H1 corresponding to a range from 150% to 300% of the diameter D1 of the first virtual circle C1, which is illustrated in FIGS. 1 and 9, or the diameter of the reflection member 61. The reflection member 61 may have the height H1 corresponding to a range from 150% to 250% of the diameter D1 of the first virtual circle C1, which is illustrated in FIGS. 1 and 9, or the diameter of the reflection member 61. When the height H1 of the reflection member 61 gets out of the above-described range, light reflection efficiency or light extraction efficiency may be reduced to cause a difference in color sensor or brightness deterioration.

Here, a heat detection device 5 may be disposed outside the reflection member 61.

The light-emitting module 100 may include a light transmissive member 67 disposed on the circuit board 10 and also disposed within the reflection member 61. The light transmissive member 67 includes a transparent resin material such as silicon or epoxy. A phosphor may not be added to the light transmissive member 67. For another example, at least one of a diffusion agent, a dispersion agent, or a phosphor may be added to the light transmissive member 67, but is not limited thereto.

The light transmissive member 67 may come into contact with a top surface of the circuit board 10 and an inner surface of the reflection member 61. The light transmissive member 67 may have a thickness equal to or greater than a height of the reflection member 61, but is not limited thereto. A top surface of the light transmissive member 67 may include at least one of a convex surface, a concave surface, or a flat surface.

An upper diameter of the light transmissive member 67 may be greater than a lower diameter D3 thereof, but is not limited thereto.

The reflection member 61 may be disposed outside the first virtual circle C1 or on the boundary line of the first virtual circle C1 illustrated in FIG. 9. The reflection member 61 may have a circular shape or an oval or polygonal shape when viewed in an upper side.

The reflection member 61 may be coupled to holes 51, 52, and 53 of the circuit board 10 of FIG. 9. A lower portion 62 of the reflection member 61 may extend to the holes 51, 52, and 53 of the circuit board 10 as illustrated in FIGS. 9 and 10. The holes 51, 52, and 53 of the circuit board 10 may support the lower portion 62 of the reflection member 61 at different areas, respectively. The reflection member 61 may be coupled to the plurality of holes 51, 52, and 53 defined in the circuit board 10 so as to be supported on the circuit board 10. For another example, when the reflection member 61 is made of the metal material, the reflection member 61 may be insulated through an insulation material from a metal layer L1 and a wiring layer L4 of the circuit board 10.

The reflection member 61 may be coupled to the holes of the circuit board 10 and come into contact with a top surface of the circuit board 10, e.g., a protection layer L3. Thus, the reflection member 61 may adhere to the top surface of the circuit board 10 to reflect light.

As illustrated in FIG. 10, the reflection member 61 may be disposed on a top surface of the protection layer L3 of the circuit board 10. The reflection member 61 may have a bottom surface width equal to or less than a width W6 of the hole 62, but is not limited thereto.

As illustrated in FIG. 10, the lower portion 62 of the reflection member 61 may come into contact with the protection layer L3, the insulation layer L2, and the metal layer L1 of the circuit board 10 within the holes 51, 52, and 53. The holes 51, 52, and 53 may be defined in regions that do not vertically overlap the wirings of the circuit board 10. Thus, electrical short-circuit due to the reflection member 61 may be prevented.

The light-emitting module may reduce a correlated color temperature (CCT), a color rendering index (CRI), and a luminous flux variation of emitted white light. Also, the color uniformity may be improved by the reflection member to reduce a difference in color sense for each color.

Figure 11:
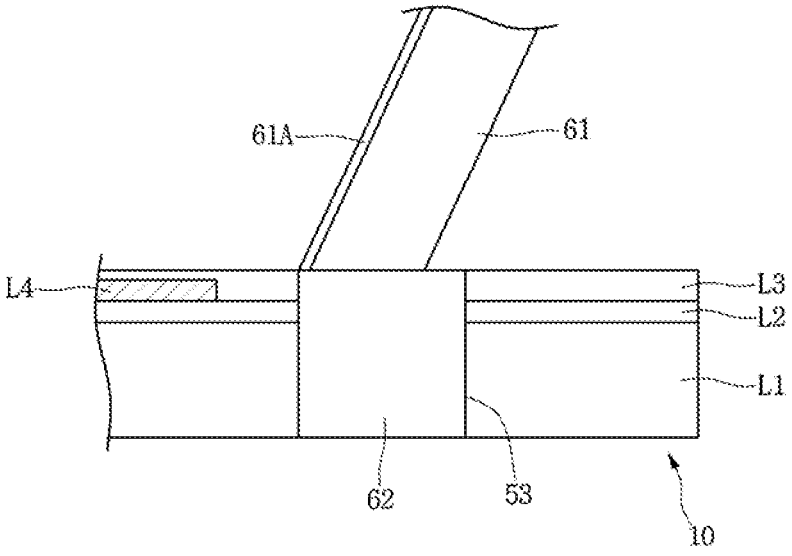
FIG. 11 is a view illustrating another example of a reflection member of the light-emitting module of FIG. 8.

FIG. 11 is a view illustrating another example of the reflection member of FIG. 10.

Referring to FIG. 11, a reflection layer 61A may be disposed on an inner surface of the reflection member 61. The reflection layer 61A may come into contact with the top surface of the circuit board 10, e.g., the protection layer L3 and be disposed so that the reflection layer 61A is not electrically connected to the wiring portion within the circuit board 10. For another example, the reflection layer 61A may be spaced apart from the top surface of the circuit board 10, e.g., the protection layer L3 or may be disposed to come into non-contact with the protection layer L3.

Figure 12:
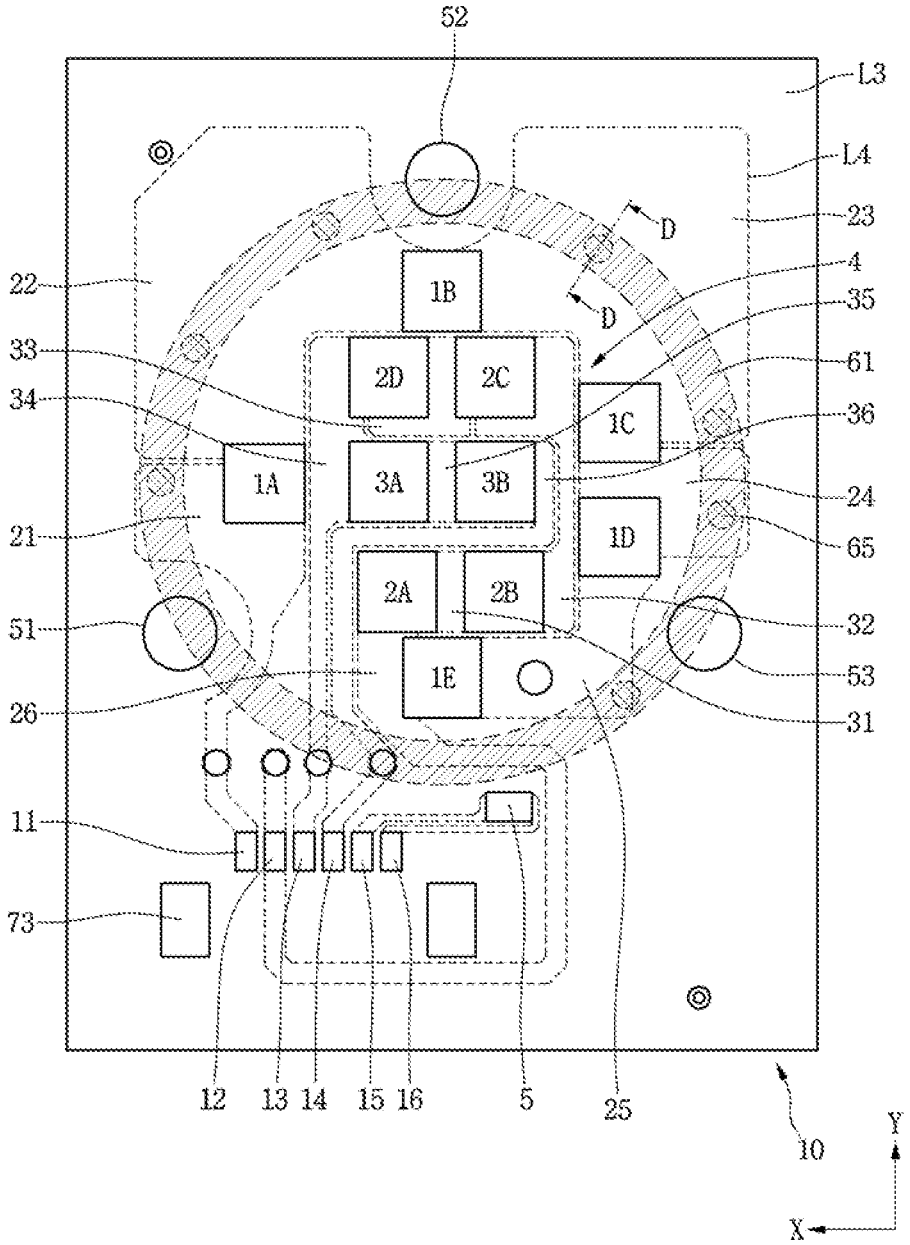
FIG. 12 is a view illustrating another example of the light-emitting module of FIG. 9 as a light-emitting module according to a third embodiment.
Figure 13:
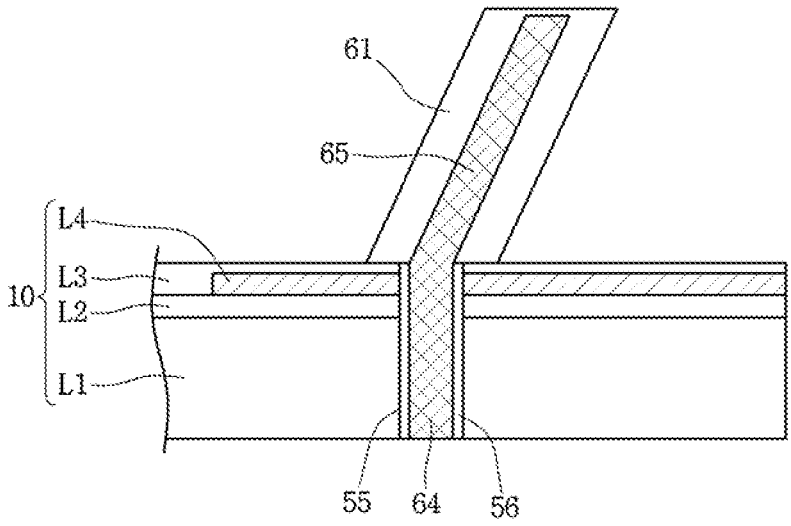
FIG. 13 is a cross-sectional view taken along line D-D of FIG. 12.

FIG. 12 is a view illustrating another example of the light-emitting module of FIG. 9 as a light-emitting module according to a third embodiment, and FIG. 13 is a cross-sectional view taken along line D-D of FIG. 12.

Referring to FIGS. 12 and 13, the light-emitting module includes a light source part 4 including a plurality of first to third light emitting devices 1A to 1E, 2A to 2D, 3A, and 3B disposed on a circuit board 10, a reflection member 61 disposed to surround the light source part 4, and a support protrusion 65 disposed in the reflection member 61.

The reflection member 61 may be coupled to the inside of each of a plurality of holes 51, 52, and 53 defined in the circuit board 10. The reflection member 61 may include a plastic material and a resin material such as silicon or epoxy. The reflection member 61 may have a ring shape and be disposed around the light source part 4. The reflection member 61 may have a circular shape or an oval or polygonal shape when viewed in an upper side.

The reflection member 61 may include a plurality of support protrusions 65. The plurality of support protrusions 65 may be disposed to be spaced apart from each other within the reflection member 61.

The support protrusion 65 may have the same height as the reflection member 61 and be exposed to the outside. The heat dissipation efficiency may be improved through the exposure to the outside.

For another example, the support protrusion 65 may have a height less than that of the reflection member 61 and thus be buried in the reflection member 61. The support protrusion 65 may not be exposed to the outside through the reflection member 61 to prevent moisture from being permeated.

The plurality of support protrusions 65 may be disposed on a wiring area of first wiring portions 21 to 26. The support protrusions 65 may be disposed so that the support protrusions 65 vertically overlap the wirings of the third wiring portions 35 to 36 of the circuit board 10. Thus, heat conducted from the third wiring portions 35 to 36 of the circuit board 10 may be released.

One protrusion 65 or the plurality of support protrusions 65 may be disposed on three or more wirings 21, 22, 23, 24, 25, and 26 of the first wiring portions 21 to 26. For example, two or more support protrusions 65 may be disposed on the second and third wirings 12 and 13 of the first wiring portions 21 to 26, which are disposed at sides opposite to the connection terminals 11 to 16.

The plurality of support protrusions 65 may be made of a material different from that of the reflection member 61, e.g., a metal material. The support protrusion 65 may be made of an aluminum material, a copper material, or a silver material, but is not limited thereto.

As illustrated in FIG. 13, the support protrusion 65 may pass through a via hole 55 of the circuit board 10 and be insulated from the metal layer L1 by an insulation material 56. The support protrusion 65 may not be electrically connected to the wiring layer L4 of the circuit board 10.

Since the plurality of support protrusions 65 are disposed on the first wiring portions 21 to 26, heat emitted from the first light emitting devices 1A to 1E connected to the first wiring portions 21 to 26 may be effectively released. That is, the first light emitting devices 1A to 1E having the highest heat generation characteristic may be thermally protected.

Figure 14:
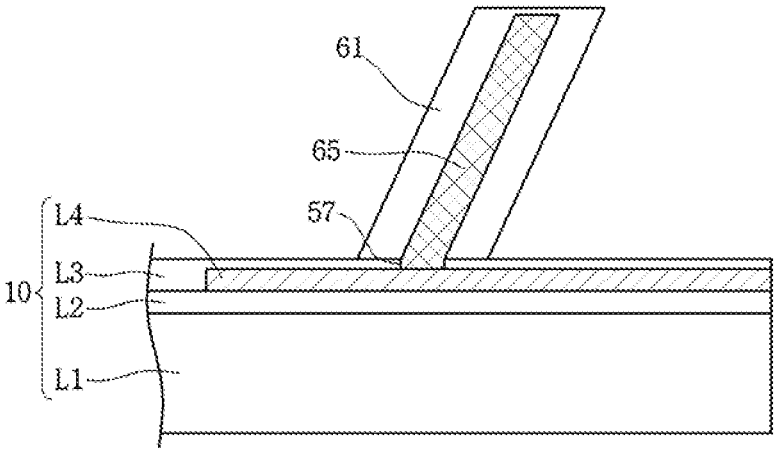
FIG. 14 is a view illustrating another example of a reflection member of the light-emitting module of FIG. 13.

FIG. 14 is a view illustrating another example of FIG. 13.

Referring to FIG. 14, the support protrusions within the reflection member 61 may come into contact with the wirings of the first wiring portions 21 to 26 as illustrated in FIG. 12, respectively. Thus, heat conducted from the wirings of the first wiring portions 21 to 26 may be released through the support protrusions 65. That is, a heat releasing surface area may increase by the wirings and the support protrusions 65.

For another example, the support protrusions 65 within the reflection member 61 may come into non-contact with the wirings of the first wiring portions 21 to 26 and come into contact with the top surface of the protection layer L3 of the circuit board 10. The support protrusions 65 may release heat conducted through the protection layer L3.

Figure 15:
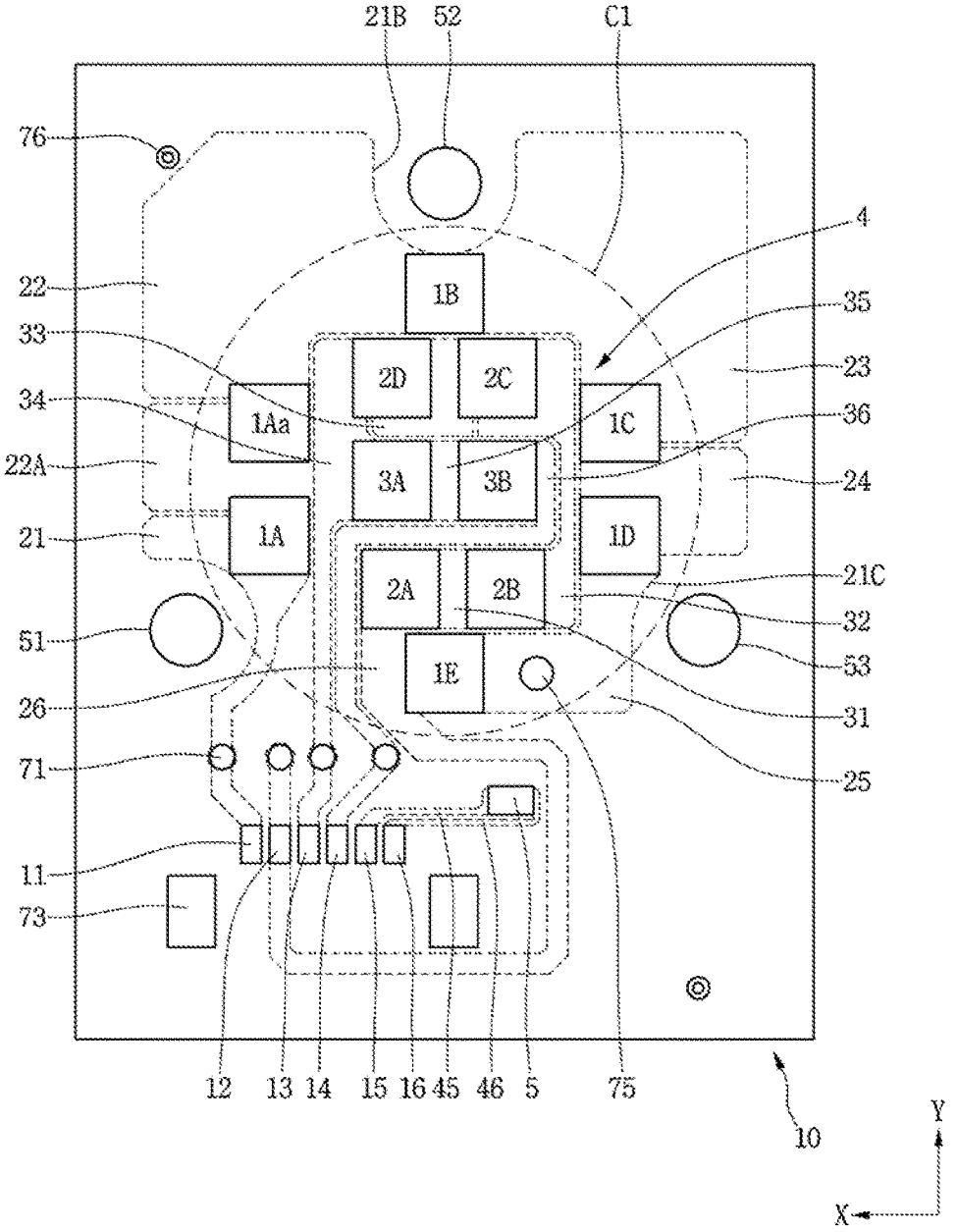
FIG. 15 is a plan view of a light-emitting module according to a fourth embodiment.

FIG. 15 is a view of a light-emitting module according to a fourth embodiment.

Referring to FIG. 15, a light-emitting module includes a light source part 4 including a plurality of light emitting devices 1A, 1Aa, 1B, 1C, 1D, and 1E on a circuit board 10 and a plurality of second and third light emitting devices 1A to 1E, 2A to 2D, 3A, and 3B disposed inside the first light emitting devices 1A to 1E. A reflection member 61 disclosed in the second embodiment may be disposed around the light source part 4.

The first light emitting devices 1A, 1Aa, 1B, 1C, 1D, and 1E may be arranged in series, and the plurality of first light emitting devices 1A, 1Aa, 1B, 1C, 1D, and 1E may be disposed inside a first virtual circle C1 along the first virtual circle C1.

The opposite devices of the plurality of first light emitting devices 1A, 1Aa, 1B, 1C, 1D, and 1E may be disposed to face each other. For example, pair of devices 1A/1D, 1Aa/1C, and 1B/1E, which are disposed opposite to each other, of the first light emitting devices 1A, 1Aa, 1B, 1C, 1D, and 1E may be disposed to face or correspond to each other. That is, in case of an even number, two pairs of devices may be disposed to face each other. The wirings of the first wiring portions 21, 22A, 22, 23, 24, 35, and 26 may connect the first to sixth devices 1A, 1Aa, 1B, 1C, 1D, and 1E to each other.

The plurality of first light emitting devices 1A, 1Aa, 1B, 1C, 1D, and 1E may emit red light and be disposed outside the second and third light emitting devices 2A to 2D, 3A, and 3B. The second light emitting devices 2A to 2D may emit green light and be disposed on both sides of the third light emitting devices 3A and 3B. The third light emitting devices 3A and 3B may emit blue light and be disposed inside the first light emitting devices 1A, 1Aa, 1B, 1C, 1D, and 1E and the second light emitting devices 2A to 2D.

Figure 16:
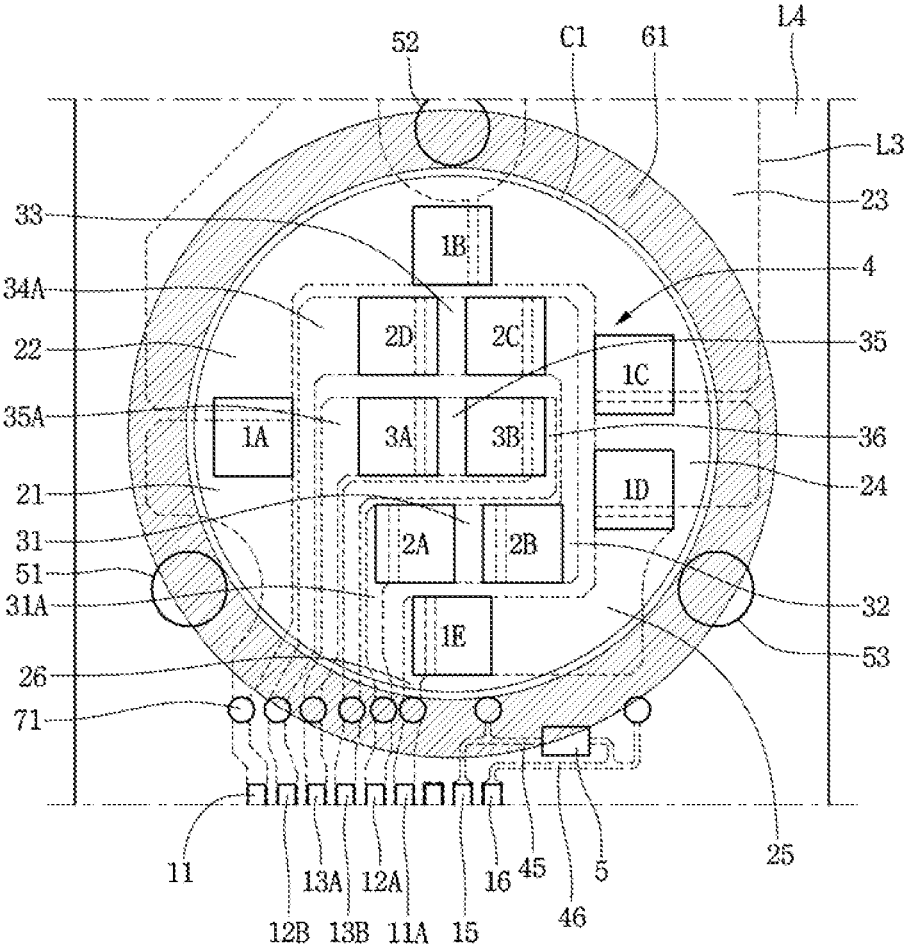
FIG. 16 is a view illustrating another example of the light-emitting module of FIG. 15.

FIG. 16 is a view of a light-emitting module according to a fourth embodiment. In description of FIG. 16, the same part as that of the foregoing embodiments will be described with reference to the foregoing embodiments.

Referring to FIG. 16, a light-emitting module includes a circuit board 10 on which a light source part 4 is disposed and a reflection member 61 disposed around the light source part 4. The light-emitting module may include the light transmissive member (see reference numeral 67 of FIG. 8) that is described above.

The light source part 4 may include a plurality of first light emitting devices 1A to 1E, a plurality of second light emitting devices 2A to 2D, and a plurality of third light emitting devices 3A and 3B.

The plurality of first light emitting devices 1A to 1E may be connected to each other in series by first wiring portions 21 to 26, and first and second connection terminals 11 and 11A connected to a connector (not shown) may be disposed on both ends of the first wiring portions 21 to 26.

The plurality of second light emitting devices 2A to 2D may be connected to each other in series by the second wiring portions 31, 32, 33, and 34A, and the third and fourth connection terminals 12A and 12B connected to the connector may be disposed on both ends of the second wiring portions 31, 32, 33, and 34A.

The plurality of third light emitting devices 3A and 3B may be connected to each other in series by the third wiring portions 35A, 35, and 36, and the fifth and sixth connection terminals 13A and 13B connected to the connector may be disposed on both ends of the third wiring portions 35A, 35, and 36.

An area on which the wirings 21, 22, 23, 24, 25, and 26 of the first wiring portions 21 to 26 are disposed may be disposed around the outside of the second wiring portions 31, 32, 33, and 34A. Here, the second wiring portions 31, 32, 33, and 34A may exclude the connection wirings connected to the third and fourth connection terminals 12A and 12B.

An area on which the wirings 21, 22, 23, 24, 25, and 26 of the first wiring portions 21 to 26 are disposed may be disposed outside the third wiring portions 35A, 35, and 36. Here, the third wiring portions 35A, 35, and 36 may exclude the connection wirings connected to the fifth and sixth connection terminals 13A and 13B.

The output-side wirings of the first wiring portions 21 to 26 may be separated from the input-side wirings of the second wiring portions 31, 32, 33, and 34A, and the output-side wirings of the second wiring portions 31, 32, 33, and 34A may be separated from the input-side wirings of the third wiring portions 35A, 35, and 36.

The first to sixth connection terminals 11, 11A, 12A, 12B, 13A, and 13B may control supply of current to each of the first to third light emitting devices 1A to 1E, 2A to 2D, 3A, and 3B to drive the first to third light emitting devices 1A to 1E, 2A to 2D, 3A, and 3B according to colors.

The plurality of first light emitting devices 1A to 1E may be disposed between the outside of the second and third light emitting devices 2A to 2D, 3A and 3B and the reflection member 61. The plurality of first light emitting devices 1A to 1E may be provided in number greater than that of second or third light emitting devices 2A to 2D or 3A and 3B.

The reflection member 61 is disposed on the first to third light emitting devices 3A and 3B, i.e., around the light source part 4. The reflection member 61 may include at least one of a plastic material and a resin material such as silicon or epoxy. A reflection layer made of a metal material may be disposed on an inner surface of the reflection member 61. A plurality of support protrusions may be disposed in the reflection member 61, but is not limited thereto.

The above-described reflection member 61 according to this embodiment may be coupled to holes 51, 52, and 53 of the circuit board 10.

A support protrusion according to the foregoing embodiment may be coupled to the inside of the reflection member 60, but is not limited thereto.

Figure 17:
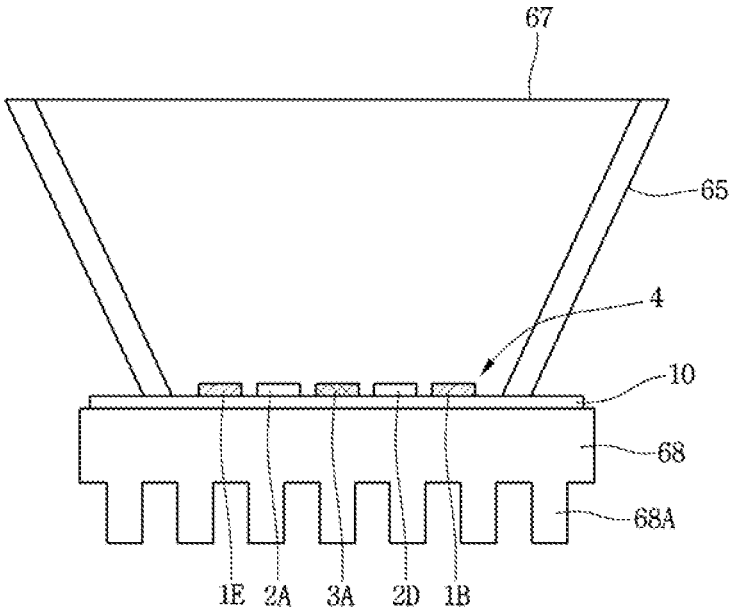
FIG. 17 is a side cross-sectional view of the light-emitting module of FIG. 15.

FIG. 17 is a view of a light-emitting module according to a fifth embodiment.

Referring to FIG. 17, a light-emitting module includes a circuit board 10, a light source part 4 disposed on the circuit board 10 according to an embodiment, a reflection member 61 disposed on the light source part 4, a light transmissive member 67 disposed in the reflection member 61, and a heat dissipation body 68 disposed on a bottom surface of the circuit board 10. The circuit board 10, the light source part 4, and the reflection member 61 will be described with reference to the descriptions disclosed in the foregoing embodiment(s).

The light transmissive member 67 includes a transparent resin material such as silicon or epoxy. A phosphor may not be added to the light transmissive member 67. For another example, a phosphor, e.g., a yellow or red phosphor may be added to the light transmissive member 67, but is not limited thereto.

The light transmissive member 67 may come into contact with a top surface of the circuit board 10 and an inner surface of the reflection member 61. The light transmissive member 67 may have a thickness equal to or greater than a height of the reflection member 61, but is not limited thereto. A top surface of the light transmissive member 67 may include at least one of a convex surface, a concave surface, or a flat surface. An upper inner diameter of the light transmissive member 67 may be greater than a lower inner diameter thereof, but is not limited thereto.

The heat dissipation body 68 may have one surface on which the light source part 4 is disposed. Here, the one surface may be a flat one surface or a surface having a predetermined curve.

The heat dissipation body 68 may have a thickness greater than that of the circuit board 10. The heat dissipation body 68 may have a thickness less than that of the light transmissive member 67.

The heat dissipation body 68 may include a heat dissipation pin 68A. The heat dissipation pin 68A may protrude or extend outward from one side of the heat dissipation body 68. A plurality of heat dissipation pins 68A may protrude in a direction opposite to the surface on which the circuit board 10 is disposed. The heat dissipation pin 68A may increase a heat dissipation area of the heat dissipation body 68 to improve heat dissipation efficiency of the light-emitting module. The heat dissipation pin 68A may have a cylindrical shape, a polyprism shape, or a pillar shape having a thickness that gradually decreases outward in a lateral cross-section.

The heat dissipation body 68 may be made of a metal material or a resin material having superior heat releasing efficiency, but is not limited thereto. For example, the heat dissipation body 68 may be made of at least one of aluminum (Al), nickel (Ni), copper (Cu), silver (Ag), and tin (Sn).

Figure 18:
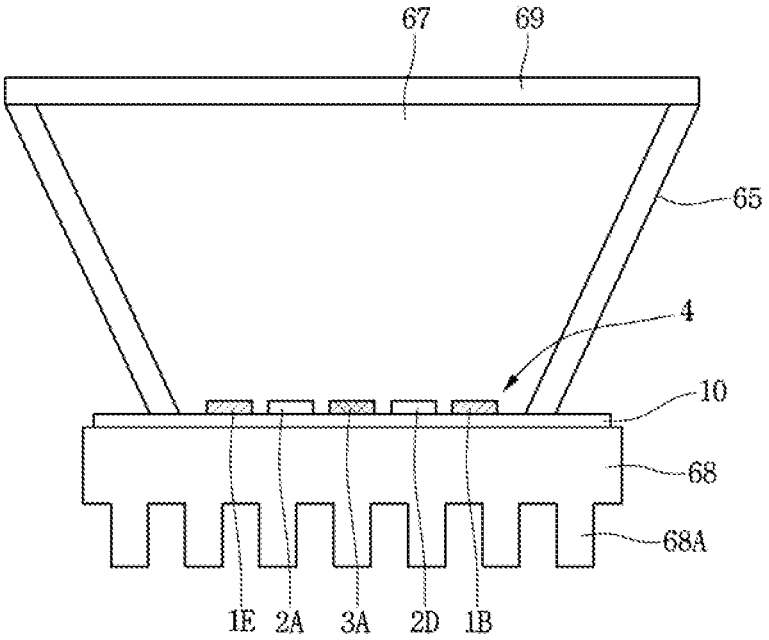
FIG. 18 is a view of a lighting unit having a light-emitting module according to an embodiment.

FIG. 18 is a view of a lighting unit provided with a light-emitting module according to an embodiment.

Referring to FIG. 18, a lighting unit includes a circuit board 10, a light source part 4 disposed on the circuit board 10 according to an embodiment(s), a reflection member 61 disposed around the light source part 4, a light transmissive member 67 disposed in the reflection member 61, an optical member 69 disposed on the reflection member, and a heat dissipation body 68 disposed on a bottom surface of the circuit board 10. The circuit board 10, the light source part 4, and the reflection member 61 will be described with reference to the descriptions disclosed in the foregoing embodiment(s).

The light transmissive member 67 disposed in the reflection member 61 may be omitted, but is not limited thereto.

The optical member 69 may include at least one a diffusion sheet, horizontal/vertical prism sheets, and a brightness enhanced sheet. The diffusion sheet diffuses incident light, the horizontal or/and vertical prism sheets collect the incident light into any area, and the brightness enhanced sheet improve brightness by reusing lost light.

When the light transmissive member 67 is provided, the optical member 69 may come into contact with the light transmissive member 67, but it not limited thereto. The light transmissive member 67 may support the optical member 69 to prevent the optical member 69 from drooping.

Although the optical member 69 having a width or surface area defined on one light-emitting module is described, when a plurality of light-emitting modules according to an embodiment are arranged, the width or surface area of the optical member 69 may be defined on the plurality of light-emitting modules, but is not limited thereto.

<Light Emitting Device>

Figure 19:
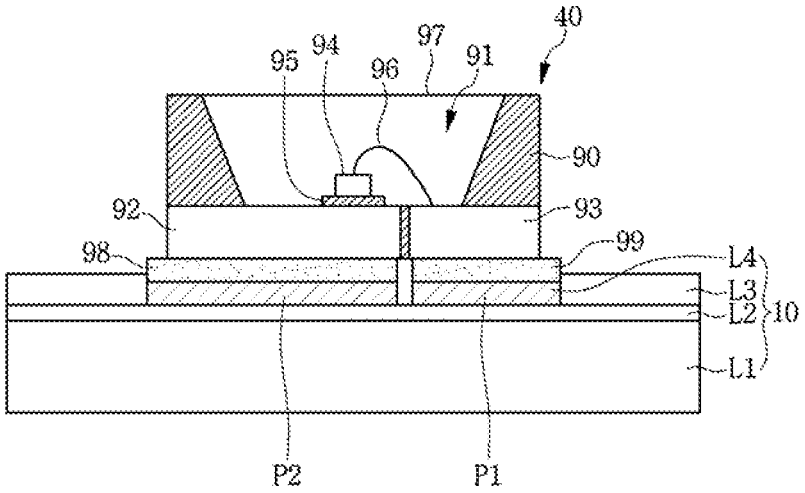
FIG. 19 is a view illustrating an example of a light emitting device of a light-emitting module according to an embodiment.

FIG. 19 is a view illustrating an example in which the light emitting device is disposed on the circuit board according to an embodiment.

Referring to FIG. 19, a light-emitting module includes a circuit board 10 and a light emitting device 40 disposed on the circuit board 10. The light emitting device 40 may be the light emitting device according to the foregoing embodiment, e.g., one of the first to third light emitting devices.

Pads P1 and P2 of the circuit board 10 are electrically connected to the light emitting device 40 by bonding members 98 and 99.

The circuit board 10 may be a metal core PCB including a metal layer, a board made of a resin material, or a flexible board, but is not limited thereto.

The circuit board 10 may include, for example, a metal layer L1, an insulation layer L2, a wiring layer L4, and a protection layer L3, but is not limited thereto. The wiring layer L4 includes the pads P1 and P2.

The light emitting device 40 may include a main body 90, a plurality of electrodes 92 and 93, a light emitting chip 94, a bonding member 95, and a molding member 97.

The main body 90 may be made of a material selected from an insulation material, a light transmissive material, a conductive material, for example, at least one of a resin material such as polyphthalamide (PPA), silicon (Si), a metal material, photo sensitive glass (PSG), sapphire ($Al_2O_3$), silicon, epoxy molding compound (EMC), a polymer-based PCB, and a plastic-based PCB. For example, the main body 90 may be made of a material selected from a resin material such as polyphthalamide (PPA) and a silicon or epoxy material. When viewed from an upper side, the main body 90 may have a polygonal shape, a circular shape, or a shape having a curved surface, but is not limited thereto.

The main body 90 may include a cavity 91, and the cavity 91 may have an opened upper portion and an inclined circumferential surface. The plurality of electrodes 92 and 93, e.g., two or three or more electrodes may be disposed on the bottom of the cavity 91. The plurality of electrodes 92 and 93 may be spaced apart from the bottom of the cavity 91. The cavity 91 may have a wide lower portion and a narrow upper portion, but is not limited thereto.

The electrodes 92 and 93 may include a metal material, for example, at least one of titanium (Ti), copper (Cu), nickel (Ni), gold (Au), chrome (Cr), tantalum (Ta), platinum (Pt), tin (Sn), silver (Ag), and phosphorous (P) and be provided as a single metal layer or a multilayered metal layer.

A gap part between the plurality of electrodes 92 and 93 may be made of an insulation material. The insulation material may be equal to or different from that of the main body 50, but is not limited thereto.

The light emitting chip 94 may be disposed on at least one of the plurality of electrodes 92 and 93 and be bonded through the bonding member 95 or flip-bonded. The bonding member 95 may be a conductive paste material including silver (Ag).

The plurality of electrodes 92 and 93 is electrically connected to the pads P1 and P2 of the wiring layer L4 of the circuit board 10 through the bonding member 98 and 99.

The light emitting chip 94 may selectively emit light in a range from a visible light band to an ultraviolet light band. For example, the light emitting chip 94 may be one of a red LED chip, a blue LED chip, a green LED chip, a yellow green LED chip, an UV ELD chip, and a white LED chip. The light emitting chip 94 may include the group III-V and/or II-VI compound semiconductors. Although the light emitting chip 94 is disposed in a chip structure having a horizontal type electrode structure, the light emitting chip may be disposed in a chip structure having a vertical type electrode structure in which two electrode are vertically disposed. The light emitting chip 94 is electrically connected to the plurality of electrodes 92 and 93 by an electrical connection member such as a wire 96.

The light emitting device 40 may be a first light emitting device that emits red light. In the first light emitting device, the light emitting chip 94 may be provided as a red LED chip or include an UV LED chip and a red phosphor.

The light emitting device 40 may be a second light emitting device that emits green light. In the second light emitting device, the light emitting chip 94 may be provided as a green LED chip or include an UV LED chip and a green phosphor.

The light emitting device 40 may be a third light emitting device that emits blue light. In the third light emitting device, the light emitting chip 94 may be provided as a blue LED chip or include an UV LED chip and a blue phosphor. The light emitting device 40 may include one or two or more LED chips, but is not limited thereto.

One or two or more light emitting chips 94 may be disposed in the cavity 91. The two or more light emitting chips may be connected to each other in series or parallel, but is not limited thereto.

The molding member 97 made of the resin material may be disposed in the cavity 91. The molding member 97 may be made of a light transmissive material such as silicon or epoxy and be provided as a single or multilayered structure. The molding member 97 may have a top surface having at least one of a flat shape, a concave shape, and a convex shape. For example, the molding member 97 may have a surface having a concave curve or a convex curve. The curved surface may be a light emission surface of the light emitting chip 94.

The molding member 97 may include a phosphor for converting a wavelength of light emitted onto the light emitting chip 94 in the transparent resin material such as silicon or epoxy. The phosphor may be selected from YAG, TAG, silicate, nitride, and oxy-nitride-based materials. The phosphor may include at least one of a red phosphor, a yellow phosphor, and a green phosphor, but is not limited thereto.

An optical lens (not shown) may be coupled to the molding member 97. The optical lens may be made of a transparent material having a refractive index of 1.4 to 1.7. Also, the optical lens may be made of a transparent resin material such as polymethylmethacrylate (PMMA) having a refractive index of 1.49, polycarbonate (PC) having a refractive index of 1.59, and an epoxy resin (EP) or transparent glass.

Figure 20:
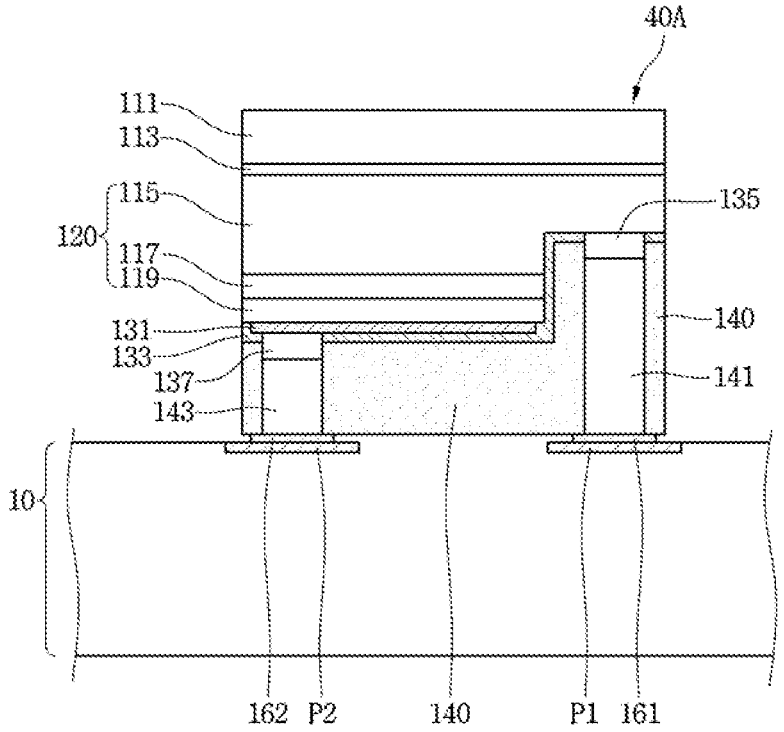
FIG. 20 is a view illustrating a first modified example of the light emitting device of the light-emitting module according to an embodiment.

FIG. 20 is a view illustrating a first modified example of the light emitting device of the light-emitting module according to an embodiment.

Referring to FIG. 20, a light-emitting module includes a circuit board 10 and a light emitting device 40A disposed on the circuit board 10. The light emitting device 40A may be the light emitting device according to the foregoing embodiment, e.g., one of the first to third light emitting devices.

Pads P1 and P2 of the circuit board 10 are electrically connected to the light emitting device 40A by bonding members 161 and 162.

The circuit board 10 may be a metal core PCB including a metal layer, a board made of a resin material, or a flexible board, but is not limited thereto.

The light emitting device 40A may include a substrate 111, a first semiconductor layer 113, a light emitting structure 120, an electrode layer 131, an insulation layer 133, a first electrode 135, a second electrode 137, a first connection electrode 141, a second connection electrode 143, and a support layer 140.

The substrate 111 may include a transmissive, insulating, or conductive substrate. For example, the substrate 111 may be formed of at least one of sapphire ($Al_2O_3$), SiC, Si, GaAs, GaN, ZnO, Si, GaP, InP, Ge, and $Ga_2O_3$. The substrate 111 may be defined as a growth substrate on which the semiconductor layer is laminated. A plurality of convex portions (not shown) may be disposed on at least one or all of top and bottom surfaces of the substrate 111 to improve light extraction efficiency. Each of the convex portions may include a hemispheric shape, a semi-elliptical surface, or a polygonal shape in a lateral cross-section. Here, the substrate 111 may be removed from the inside of the light emitting device 40A. In this case, the first semiconductor layer 113 or a first conductive type semiconductor layer 115 may be disposed on the top surface of the light emitting device 40A.

The first semiconductor layer 113 may be disposed under the substrate 111. The first semiconductor layer 113 may be formed by using the group II-V compound semiconductors. The first semiconductor layer 113 may be provided as at least one layer or plurality of layers by using the group II-V compound semiconductors. The first semiconductor layer 113 may include at least one of semiconductor layers using the group III-V compound semiconductors, e.g., GaN, InN, AlN, InGaN, AlGaN, InAlGaN, AlInN, AlGaAs, GaP, GaAs, GaAsP, AlGaInP, and GaP. The first semiconductor layer 113 may have a compositional formula of $In_xAl_yGa_{1-x-y}N$ (0=x=1, 0=y=1, 0=x+y=1) and include at least one of a buffer layer and an undoped semiconductor layer. The buffer layer may reduce a difference in lattice constant between the substrate and the nitride semiconductor layer, and the undoped semiconductor layer may improve crystalline quality of the semiconductor. Here, the first semiconductor layer 113 may be omitted.

The light emitting structure 120 may be disposed under the first semiconductor layer 113. The light emitting structure 120 may be made of a material selected from the group II-V and group III-V compound semiconductors to emit light having a predetermined peak wavelength in a wavelength range of an ultraviolet light band to a visible light band.

The light emitting structure 120 includes a first conductive type semiconductor layer 115, a second conductive type semiconductor layer 119, and an active layer 117 disposed between the first conductive type semiconductor layer 115 and the second conductive type semiconductor layer 119. The other semiconductor layer may be further disposed on at least one of top and bottom surfaces of each of the layers 115, 117, and 119, but is not limited thereto.

The first conductive type semiconductor layer 115 may be disposed under the first semiconductor layer 113 and realized as a semiconductor into which a first conductive type dopant is doped, e.g., an n-type semiconductor layer. The first conductive type semiconductor layer 115 may have a compositional formula of $In_xAl_yGa_{1-x-y}N$ (0=x=1, 0=y=1, 0=x+y=1). The first conductive type semiconductor layer 115 may be made of a material selected from the group III-V compound semiconductors, e.g., GaN, AlN, AlGaN, InGaN, InN, InAlGaN, AlInN, AlGaAs, GaP, GaAs, GaAsP, and AlGaInP. The first conductive type dopant may be an n-type dopant and include a dopant such as Si, Ge, Sn, Se, and Te.

The active layer 117 may be disposed under the first conductive type semiconductor layer 115 and have one of a single quantum well structure, a multi quantum well (MQW) structure, a quantum wire structure, and a quantum dot structure and also have a cycle of a wall layer and a barrier layer. The cycle of the wall layer/barrier layer includes, for example, at least one of pairs of InGaN/GaN, GaN/AlGaN, AlGaN/AlGaN, InGaN/AlGaN, InGaN/InGaN, AlGaAs/GaA, InGaAs/GaAs, InGaP/GaP, AlInGaP/InGaP, and InP/GaAs.

The second conductive type semiconductor layer is disposed under the active layer 117. The second conductive type semiconductor layer 119 may include a semiconductor into which a second conductive type dopant is doped, e.g., having a compositional formula of $In_xAl_yGa_{1-x-y}N$ (0=x=1, 0=y=1, 0=x+y=1). For example, the second conductive type semiconductor layer 119 may be made of at least one of compound semiconductors such as GaN, InN, AlN, InGaN, AlGaN, InAlGaN, AlInN, AlGaAs, GaP, GaAs, GaAsP, and AlGaInP. The second conductive type semiconductor layer 119 may be a p-type semiconductor layer, and the first conductive type dopant may include Mg, Zn, Ca, Sr, or Ba as a p-type dopant.

For another example of the light emitting structure 120, the first conductive type semiconductor layer 115 may be realized as a p-type semiconductor layer, and the second conductive type semiconductor layer 119 may be realized as an n-type semiconductor layer. Also, a third conductive type semiconductor layer having a polarity opposite to that of the second conductive type semiconductor layer may be disposed on the second conductive type semiconductor layer 119. Also, the light emitting structure 120 may have one structure of an n-p junction structure, a p-n junction structure, an n-p-n junction structure and a p-n-p junction structure.

The electrode layer 131 may be disposed under the second conductive type semiconductor layer 119. The electrode layer 131 may include a reflection layer. The electrode layer 131 may include an ohmic contact layer that comes into contact with the second conductive type semiconductor layer 119 of the light emitting structure 120. The reflection layer may be made of a material having reflectivity of 70% or more, e.g., one of metals such as Al, Ag, Ru, Pd, Rh, Pt, and Ir and an alloy of two or more metals of the metals. The metal of the reflection layer may come into contact with a bottom surface of the second conductive type semiconductor layer 119. The ohmic contact layer may be made of a material selected from a light transmissive material, a metal material, and a non-metal material.

The electrode layer 131 may have a laminated structure of the light transmissive electrode layer/the reflection layer. For example, the light transmissive electrode layer may be made of a material selected from indium tin oxide (ITO), indium zinc oxide (IZO), indium zinc tin oxide (IZTO), indium aluminum zinc oxide (IAZO), indium gallium zinc oxide (IGZO), indium gallium tin oxide (IGTO), aluminum zinc oxide (AZO), antimony tin oxide (ATO), gallium zinc oxide (GZO), Ag, Ni, Al, Rh, Pd, Ir, Ru, Mg, Zn, Pt, Au, Hf, and combinations thereof. The reflection layer made of a metal material may be disposed under the light transmissive electrode layer. For example, the reflection layer may be made of a material selected from Ag, Ni, Al, Rh, Pd, Ir, Ru, Mg, Zn, Pt, Au, Hf, and combinations thereof. For another example, the reflection layer may have a distributed bragg reflection structure in which two layers having different refractive indexes are alternately disposed.

A light extraction structure such as roughness may be formed on a surface of at least one layer of the second conductive type semiconductor layer 119 and the electrode layer 131. The light extraction structure may change a critical angle of incident light to improve light extraction efficiency.

The insulation layer 133 may be disposed under the electrode layer 131, e.g., disposed on a bottom surface of the second conductive type semiconductor layer 119, side surfaces of the second conductive type semiconductor layer 119 and the active layer 117, and a portion of an area of the first conductive type semiconductor layer 115. The insulation layer 133 may be disposed in a region except for the electrode layer 131, the first electrode 135, and the second electrode 137 of a lower region of the light emitting structure 120 to electrically protect the lower portion of the light emitting structure 120.

The insulation layer 133 may be made of an insulation material or an insulation resin formed of at least one of oxide, nitride, fluoride, and sulfide, which include at least one of Al, Cr, Si, Ti, Zn, and Zr. The insulation layer 133 may be made of a material selected from, for example, $SiO_2$, $Si_3N_4$, $Al_2O_3$, and $TiO_2$. The insulation layer 133 may have a single or multilayered structure, but is not limited thereto. When a metal structure for flip bonding is formed under the light emitting structure 120, the insulation layer 133 may prevent short-circuit between the layers of the light emitting structure 120 from occurring.

The insulation layer 133 may have a distributed bragg reflector (DBR) structure in which first and second layers having different refractive indexes are alternately disposed. Here, the first layer may be made of one of $SiO_2$, $Si_3N_4$, $Al_2O_3$, and $TiO_2$, and the second layer may be made of a material except for the material of the first layer, but is not limited thereto. Alternatively, the first and second layers may be made of the same material or provided as a pair having three or more layers. In this case, the electrode layer may be omitted.

The first electrode 135 may be disposed under a portion of a region of the first conductive type semiconductor layer 115, and the second electrode 137 may be disposed under a portion of the electrode layer 131. The first connection electrode 141 may be disposed under the first electrode 135, and the second connection electrode 143 may be disposed under the second electrode 137.

The first electrode 135 may be electrically connected to the first conductive type semiconductor layer 115 and the first connection electrode 141, and the second electrode may be electrically connected to the second conductive type semiconductor layer 119 and the second connection electrode 143 through the electrode layer 131.

The first electrode 135 and the second electrode 137 may be made of at least one of Cr, Ti, Co, Ni, V, Hf, Ag, Al, Ru, Rh, Pt, Pd, Ta, Mo, and W or an allow thereof and have a single or multilayered structure. The first electrode 135 and the second electrode 137 may have the same laminated structure or different laminated structures. At least one of the first electrode 135 and the second electrode 137 may further include a current spreading pattern having an arm or finger structure. Also, each of the first electrode 135 and the second electrode 137 may be provided in one or plurality, but is not limited thereto. At least one of the first and second connection electrodes 141 and 143 may be provided in plurality, but is not limited thereto.

Each of the first connection electrode and the second connection electrode 143 may function as a lead for supplying power and provide a heat releasing path. Each of the first connection electrode 141 and the second connection electrode 143 may have at least one of a circular shape, a polygonal shape, a cylindrical shape, or a polyprism shape. Each of the first connection electrode 141 and the second connection electrode 143 may be made of a metal powder material, e.g., Ag, Al, Au, Cr, Co, Cu, Fe, Hf, In, Mo, Ni, Si, Sn, Ta, Ti, W, and an alloy selected from the metals. Each of the first connection electrode 141 and the second connection electrode 143 may be formed by plating one metal of In, Sn, Ni, Cu, and an alloy selected from the metals to improve adhesion with the first electrode 135 and the second electrode 137.

The support layer 140 may be made of a heat conductive material and disposed around the first electrode 135, the second electrode 137, the first connection electrode 141, and the second connection electrode 143. Bottom surfaces of the first and second connection electrodes 141 and 143 may be exposed through a bottom surface of the support layer 140.

The support layer 140 may be used as a layer supporting the light emitting device 40A. The support layer 140 may be made of an insulation material. The insulation material may include a resin material such as silicon or epoxy. For another example, the insulation material may include paste or insulation ink. A kind of insulation material may include alone or combinations of a polyacrylate resin, an epoxy resin, a phenolic resin, a polyamides resin, a polyimides resin, an unsaturated polyesters resin, a polyphenylene ether resin (PPE), a polyphenilene oxide resin (PPO), a polyphenylenesulfides resin, a cyanate ester resin, benzocyclobutene (BCB), polyamido-amine dendrimers (PAMAM), polypropylene-imine, dendrimers (PPI), and PAMAM-OS (organosilicon) having a PAMAM internal structure and an organic-silicon outer surface. The support layer 140 may be made of a material different from that of the insulation layer 133.

At least one of compounds such as oxide, nitride, fluoride, and sulfide, which include at least one of Al, Cr, Si, Ti, Zn, and Zr, may be added to the support layer 140. Here, the compound added to the support layer 140 may serve as a heat dispersing agent. The heat dispersing agent may be used as a powder particle having a predetermined size, a grain, a filler, and an additive. The heat dispersing agent may include a ceramic material. The ceramic material may include at least one of low temperature co-fired ceramic (LTCC), high temperature co-fired ceramic (HTCC), alumina, quartz, calcium zirconate, forsterite, SiC, graphite, fusedsilica, mullite, cordierite, zirconia, beryllia, and aluminum nitride. The ceramic material may include metal nitride, which has heat conductivity greater than that of nitride or oxide, of the insulation material such as nitride or oxide, and the metal oxide may include, for example, a material having heat conductivity of 140 W/mK or more. The ceramic material may be a ceramic-based material, for example, such as $SiO_2$, $Si_xO_y$, $Si_3N_4$, $Si_xN_y$, $SiO_xN_y$, $Al_2O_3$, BN, $Si_3N_4$, SiC(SiC—BeO), BeO, CeO, and AlN. The heat conductive material may include a component of C (diamond, CNT).

The first and second connection electrodes 141 and 143 of the light emitting device 40A may be mounted in a flip manner on the pads P1 and P2 of the circuit board 10 by the bonding members 161 and 162. The protection layer (not shown) may be disposed on the top surface of the circuit board 10. The protection layer may be made of a reflection material, for example, a resist material, for example, a white resist material, but is not limited thereto.

Figure 21:
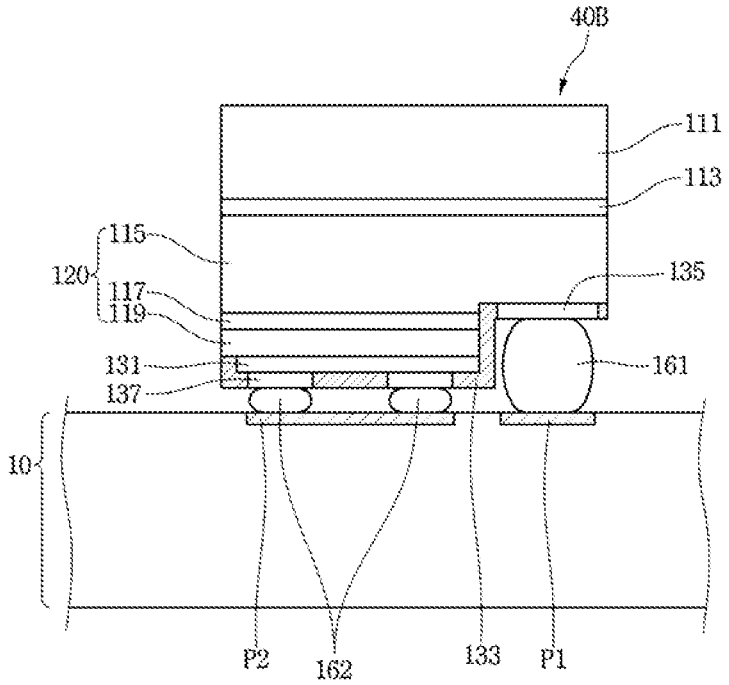
FIG. 21 is a view illustrating a second modified example of the light emitting device of the light-emitting module according to an embodiment.

FIG. 21 is a view illustrating a second modified example of the light emitting device of the light-emitting module according to an embodiment.

Referring to FIG. 21, a light-emitting module includes a circuit board 10 and a light emitting device 40B disposed on the circuit board 10. The light emitting device 40B may be the light emitting device according to the foregoing embodiment, e.g., one of the first to third light emitting devices.

The light emitting device 40B may include a substrate 111, a first semiconductor layer 113, a light emitting structure 120, an electrode layer 131, an insulation layer 133, a first electrode 135, a second electrode 137, a first connection electrode 141, a second connection electrode 143, and a support layer 140. The substrate 111 and the second semiconductor layer 113 may be removed.

The light emitting device 40B and the circuit board 10 may be connected to each other through connection electrodes 161 and 162. Pads P1 and P2 of the circuit board 10 may be bonded to the light emitting device 40B through the connection electrodes 161 and 162.

Each of the connection electrodes 161 and 62 may include a conductive bump, i.e., a solder bump. One or plurality of connection electrodes 161 and 162 may be arranged under each of the electrodes 135 and 137, but is not limited thereto. The insulation layer 133 may expose the first and second electrodes 135 and 137, and the connection electrodes 161 and 162 may connect the first and second electrodes 135 and 137 to the pads P1 and P2 of the circuit board 10.

Figure 22:
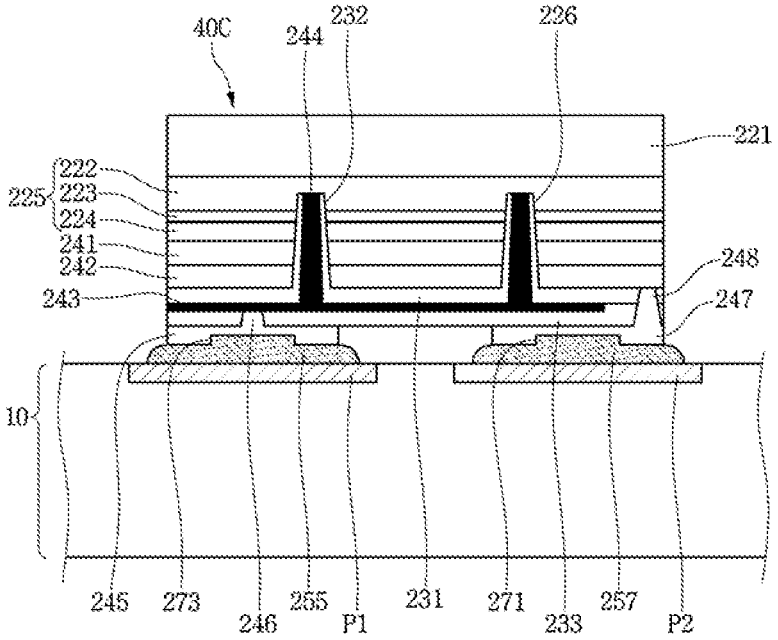
FIG. 22 is a view illustrating a third modified example of the light emitting device of the light-emitting module according to an embodiment.

FIG. 22 is a view illustrating a third modified example of the light emitting device of the light-emitting module according to an embodiment.

Referring to FIG. 22, a light-emitting module includes a circuit board 10 and a light emitting device 40C disposed on the circuit board 10. The light emitting device 40C may be the light emitting device according to the foregoing embodiment, e.g., one of the first to third light emitting devices.

The circuit board 10 may be a metal core PCB including a metal layer, a board made of a resin material, or a flexible board, but is not limited thereto.

The light emitting device 40C is connected to the circuit board 10. The light emitting device 40C includes a light emitting structure 225 and a plurality of electrodes 245 and 247. The light emitting structure 225 may be provided as the group II-VI compound semiconductor layer, for example, the group III-V compound semiconductor layer or the group II-VI compound semiconductor layer. The plurality of electrodes 245 and 247 may be selectively connected to the semiconductor layer of the light emitting structure 225 to supply power.

The light emitting structure 225 may include a first conductive type semiconductor layer 222, an active layer 223, and a second conductive type semiconductor layer 224. The light emitting device 200 may include a substrate 221. The substrate 221 may be disposed on the light emitting structure 225. The substrate 221 may be, for example, a light transmissive or insulation substrate or a conductive substrate.

Electrodes 245 and 247 may be disposed on a lower portion of the light emitting device 40C, and the electrodes 245 and 247 may include first and second electrodes 245 and 247. The first and second electrodes 245 and 247 are disposed spaced apart from each other under the light emitting device 200. The first electrode 245 is electrically connected to the first conductive type semiconductor layer 222, and the second electrode 247 is electrically connected to the second conductive type semiconductor layer 224. Each of the first and second electrodes 245 and 247 may have a bottom shape having a polygonal or circular shape to correspond to that of each of the pads P1 and P2 of the circuit board 10. Each of the first and second electrodes 245 and 247 may have a bottom surface area corresponding to a top surface area of each of the first and second electrodes 415 and 417.

The light emitting device 40C may include at least one of a buffer layer (not shown) and an undoped semiconductor layer (not shown) between the substrate 221 and the light emitting structure 225. The buffer layer may be a layer for reducing a lattice constant different between the substrate 221 and the semiconductor layer and may be made of a material selected from the group II-VI compound semiconductors. An undoped group III-V compound semiconductor layer may be further disposed under the buffer layer 112, but is not limited thereto. The substrate 221 may be removed. When the substrate is removed, a top surface of the first conductive type semiconductor layer 222 or a top surface of the other semiconductor layer may be exposed.

The light emitting device 40C includes first and second electrode layers 241 and 242, a third electrode layer 243, and insulation layers 231 and 233. Each of the first and second electrode layers 241 and 242 may have a single or multi-layered structure and function as a current spreading layer. The first and second electrode layers 241 and 242 may include a first electrode layer 241 disposed under the light emitting structure 225 and a second electrode layer 242 disposed under the first electrode layer 241. The first electrode layer 241 may spread current, and the second electrode layer 241 may reflect incident light.

The first and second electrode layers 241 and 242 may be made of materials different from each other. The first electrode layer 241 may be made of a light transmissive material, for example, metal oxide or metal nitride. The first electrode layer may be made of a material selected from indium tin oxide (ITO), ITO nitride (ITON), indium zinc oxide (IZO), IZO nitride (IZON), indium zinc tin oxide (IZTO), indium aluminum zinc oxide (IAZO), indium gallium zinc oxide (IGZO), indium gallium tin oxide (IGTO), aluminum zinc oxide (AZO), antimony tin oxide (ATO), and gallium zinc oxide (GZO). The second electrode layer 242 may come into contact with a bottom surface of the first electrode layer 241 and function as a reflection electrode layer. The second electrode layer 242 may be made of a metal, for example, Ag, Au, or Al. When a portion of a region of the first electrode layer 241 is removed, the second electrode layer 242 may come into partial contact with the bottom surface of the light emitting structure 225.

For another example, the first and second electrode layers 241 and 242 may be laminated with an omni directional reflector layer (ODR) structure. The ODR structure may be a structure in which the first electrode layer 241 having a low refractive index and the second electrode layer 242 coming into contact with the first electrode layer 241 and made of a metal material having high reflectivity are laminated. The electrode layers 241 and 242 may have, for example, a laminated structure of ITO/Ag. A total orientation reflection angle may be improved at an interface between the first electrode layer 241 and the second electrode layer 242.

For another example, the second electrode layer 242 may be removed or provided as a reflection layer made of different material. The reflection layer may have a distributed bragg reflector (DBR) structure. The DBR structure may include a structure in which two dielectric layers having different refractive indexes are alternately disposed, for example, may include one of a $SiO_2$ layer, a $Si_3N_4$ layer, a $TiO_2$ layer, a $Al_2O_3$ layer, and a MgO layer. For another example, the electrode layers 241 and 242 may include all of the DBR structure and the ODR structure. In this case, the light emitting device 40C having light reflectivity of 98% or more may be provided. Since the light emitting device 40C mounted in the flip manner emits light reflected from the second electrode layer 242 through the substrate 221, most of light may be released in a vertical upward direction.

The third electrode layer 243 may be disposed under the second electrode layer 242 and electrically insulated from the first and second electrode layers 241 and 242. The third electrode layer 243 may be made of a metal, for example, at least one of titanium (Ti), copper (Cu), nickel (Ni), gold (Au), chrome (Cr), tantalum (Ta), platinum (Pt), tin (Sn), silver (Ag), and phosphorus (P). The first electrode 245 and the second electrode 247 are disposed under the third electrode layer 243. The insulation layers 231 and 233 may prevent unnecessary contact between the layers of the first and second electrode layers 241 and 242, the third electrode layer 243, the first and second electrodes 245 and 247, and the light emitting structure 225 from occurring. The insulation layers 231 and 233 include first and second insulation layers 231 and 233. The first insulation layer 231 is disposed between the third electrode layer 243 and the second electrode layer 242. The second insulation layer 233 is disposed between the third electrode layer 243 and the first/second electrodes 245 and 247. The first and second electrodes 245 and 247 may be made of the same material as each of the pads P1 and P2.

The third conductive layer 243 is connected to the first conductive type semiconductor layer 222. A connection part 244 of the third electrode layer 243 protrudes from a via structure through the first and second electrode layers 241 and 242 and the light emitting structure 225 to come into contact with the first conductive type semiconductor layer 222. The connection part 244 may be provided in plurality. A portion 232 of the first insulation layer 231 extends to the surrounding of the connection part 224 of the third electrode layer 243 to prevent the third insulation layer 243, the first and second electrode layers 241 and 242, the second conductive type semiconductor layer 224, and the active layer 223 from being electrically connected to each other. An insulation layer may be disposed on a side surface of the light emitting structure 225 to protect the side surface, but is not limited thereto.

The second electrode 247 is disposed under the second insulation layer 233 and comes into contact with or is connected to at least one of the first and second electrode layers 241 and 242 through an opened region of the second insulation layer 233. The first electrode 245 is disposed under the second insulation layer 233 and connected to the third electrode layer 243 through the opened region of the second insulation layer 233. Thus, a protrusion 248 of the first electrode 247 is electrically connected to the second conductive type semiconductor layer 224 through the first and second electrode layers 241 and 242, and a protrusion 246 of the second electrode 245 is electrically connected to the first conductive type semiconductor layer 222 through the third electrode layer 243.

The first and second electrodes 245 and 247 are spaced apart from a lower portion of the light emitting device 40C to face the pads P1 and P2 of the circuit board 10. Each of the first and second electrodes 245 and 247 may include recesses 271 and 273 each of which has a polygonal shape. Each of the recesses 271 and 273 may protrude toward the light emitting structure 225. Each of the recesses 271 and 273 may have a thickness equal to each of the first and second electrodes 245 and 247 or a depth less than that of each of the first and second electrodes 245 and 247. The depth of each of the recesses 271 and 273 may increase a surface area of each of the first and second electrodes 245 and 247.

Bonding members 255 and 257 are disposed in a region between the first electrode 245 and the first pad P1 and a region between the second electrode 247 and the second pad P2, respectively. The bonding members 255 and 257 may include an electrical conductive material, and portions of the bonding members 255 and 257 may be respectively disposed in the recesses 271 and 273. Since the bonding members 255 and 257 are disposed in the recesses 271 and 273 in the first and second electrodes 245 and 247, bonding areas between the bonding members 255 and 257 and the first and second electrodes 242 and 247 may increase. Thus, since the first and second electrodes 245 and 247 and the first and second pods P1 and P2 are bonded to each other, the light emitting device 40C may be improved in electrical reliability and heat dissipation efficiency.

Each of the bonding members 255 and 257 may be made of a solder paste material. The solder paste material may include at least one of gold (Au), tin (Sn), lead (Pb), copper (Cu), bismuth (Bi), indium (In), and silver (Ag). Since the bonding members 255 and 257 directly conducts heat to the circuit board 10, the heat conduction efficiency may be improved when compared to a structure using a package. Also, since each of the bonding members 255 and 257 is made of a material having low thermal expansion coefficient with respect to the first and second electrodes 245 and 247 of the light emitting device 40C, the heat conduction efficiency may be improved.

For another example, the bonding members 255 and 257 may include conductive films. Each of the conductive films includes one or more conductive particles in an insulation film. The conductive particles may be made of, for example, at least one of a metal, a metal alloy, and carbon. The conductive particles may be made of at least one of nickel, silver, gold, aluminum, chrome, copper, and carbon. The conductive film may include an anisotropic conductive film or an anisotropic conductive adhesive.

An adhesion member, e.g., a heat conductive film may be disposed between the light emitting device 40C and the circuit board 10. The heat conductive film may be made of a polyester resin such as polyethylene terephthalate, polybutylene terephthalide, polyethylene naphthalate, and polybutylene naphthalate; a polyimide resin; an acrylic resin; a styrene-based resin such as polystyrene and acrylonitrile-styrene; a polycarbonate resin; a polylactic acid resin; and a polyurethane resin. Also, the heat conductive film may be made of a polyolefin resin such as polyethylene, polypropylene and ethylene-propylene copolymer; a vinyl resin such as polyvinyl chloride and polyvinylidene chloride; a polyamide resin; a sulfonic resin; a polyether-ether ketone resin; an allylate-based resin; or blends of the resins.

The light emitting device 40C emits light through a surface of the circuit board 10 and side and top surfaces of the light emitting structure 225 to improve the light extraction efficiency. The light emitting device 40C may be directly bonded to the circuit board 10 to simplify a process. Also, since the heat dissipation of the light emitting device 40C is improved, the light emitting device 40C may be usefully utilized in lighting fields.

<Lighting Apparatus>

Figure 23:
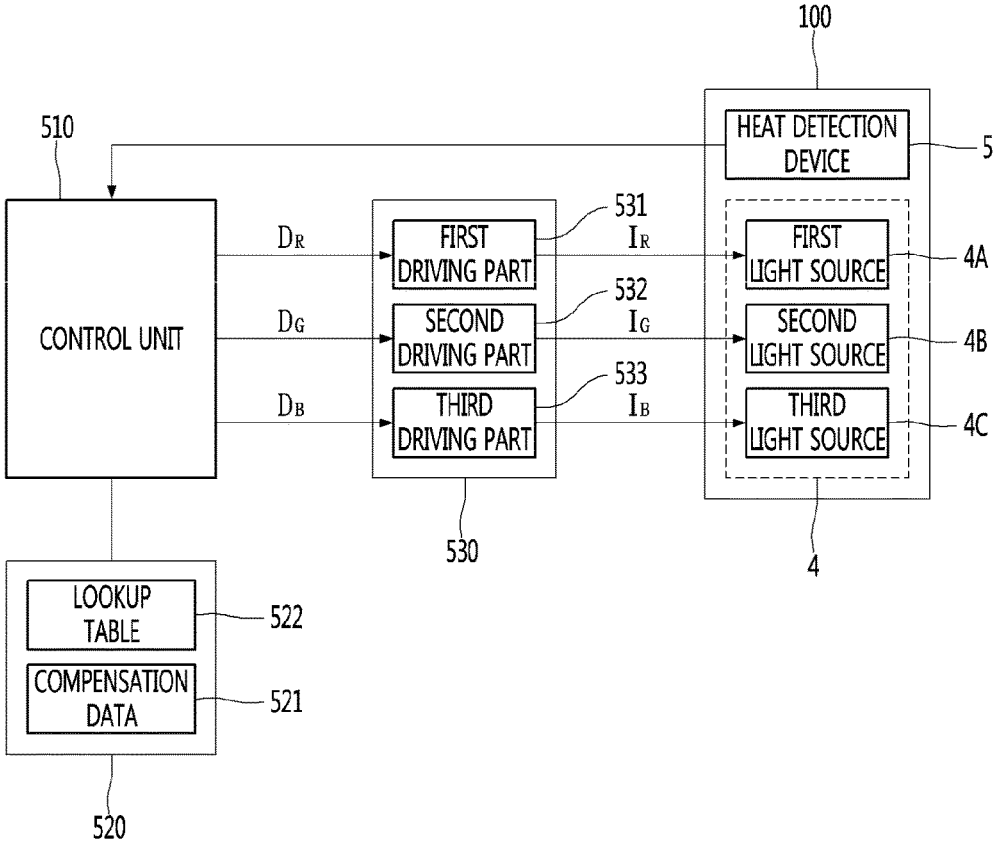
FIG. 23 is a view of a lighting unit provide with a light-emitting module according to an embodiment.
Figure 24:
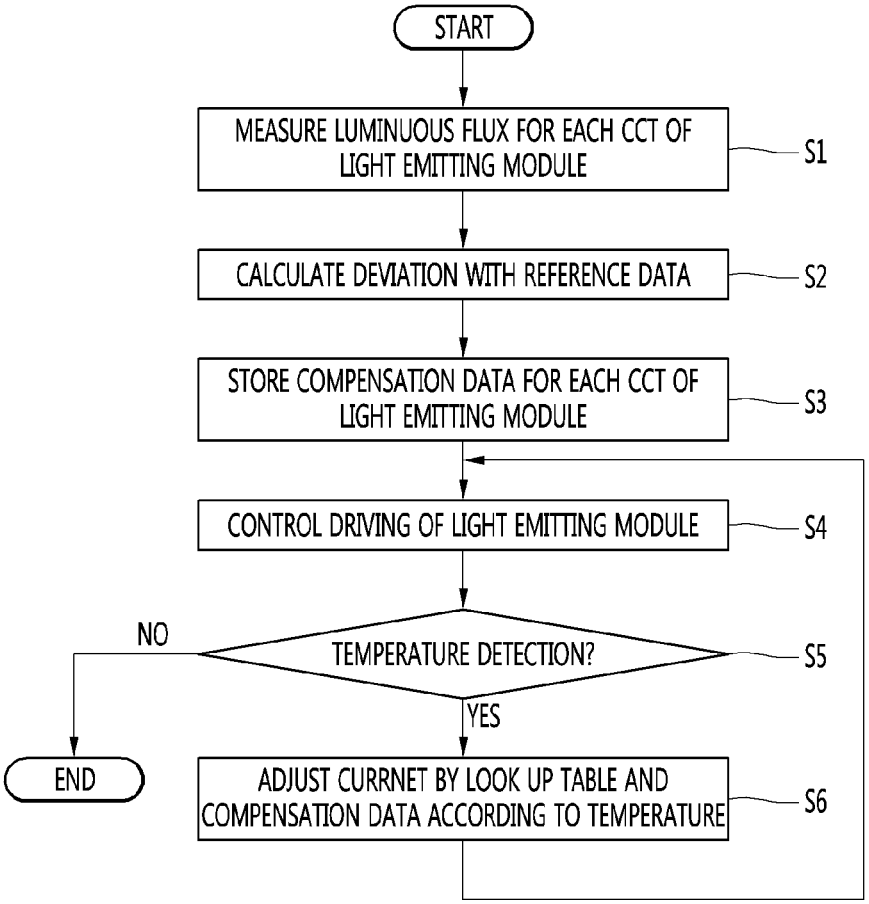
FIG. 24 is a view illustrating a method for controlling a lighting of the lighting apparatus provided with the light-emitting module according to an embodiment.
Figure 25:
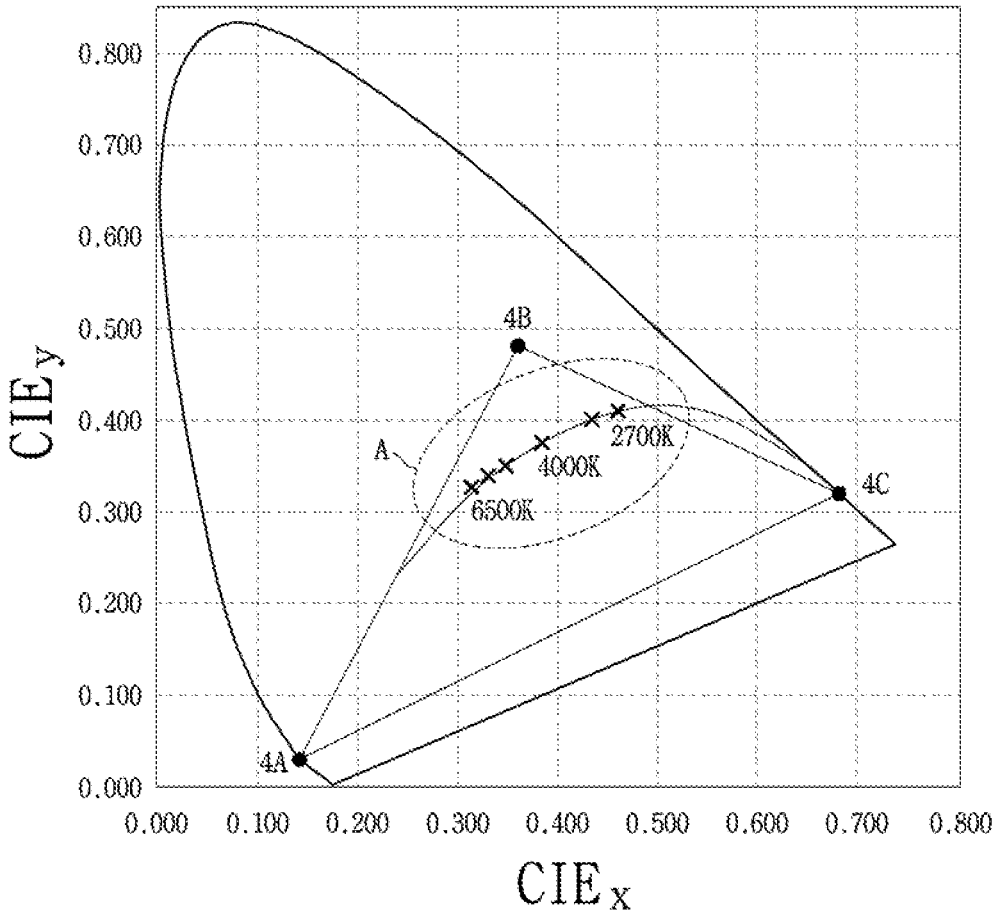
FIG. 25 is a view illustrating a color temperature of light emitted from the lighting apparatus as a CIE 1931 chromaticity diagram according to an embodiment.
Figure 26:
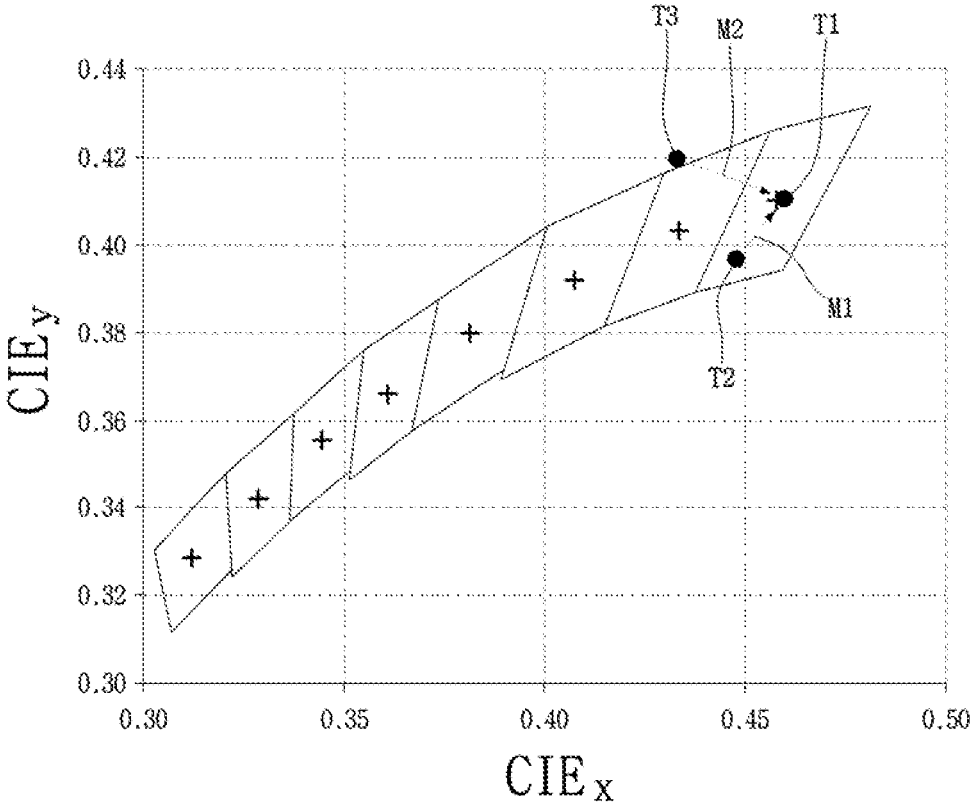
FIG. 26 is a CIE 1931 chromaticity diagram, which is illustrated by enlarging an area A of FIG. 25.
Figure 27:
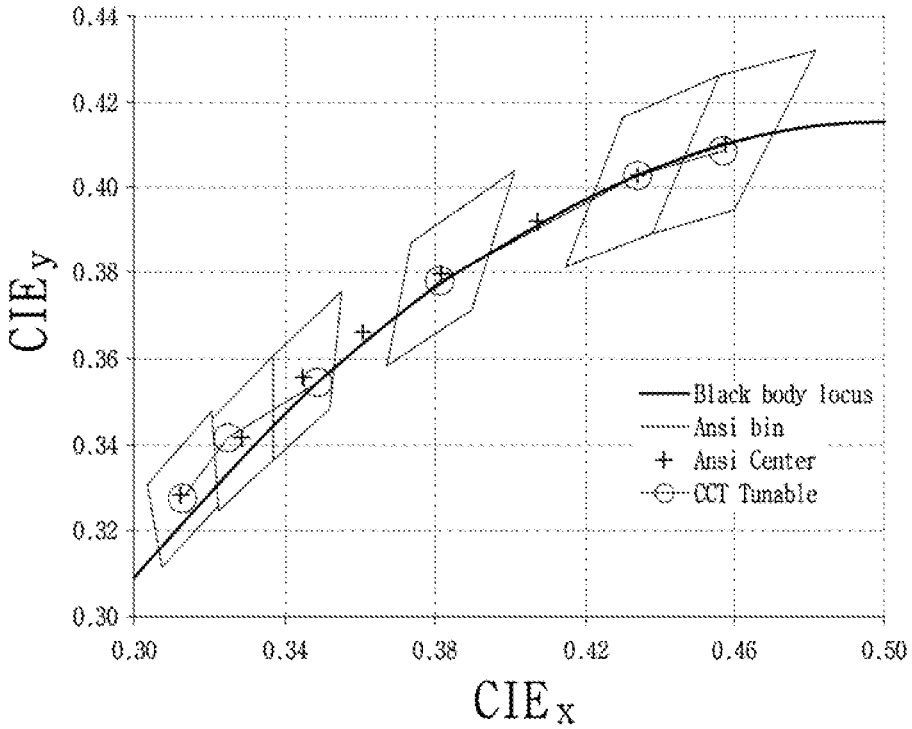
FIG. 27 is a view illustrating an example of a color control on the CIE 1931 chromaticity diagram of FIG. 26 in the lighting apparatus according to an embodiment.

FIG. 23 is a view of a lighting unit provide with a light-emitting module according to an embodiment, FIG. 24 is a view illustrating a method for controlling a lighting of the lighting apparatus provided with the light-emitting module according to an embodiment, FIG. 25 is a view illustrating a color temperature of light emitted from the lighting apparatus as a CIE 1931 chromaticity diagram according to an embodiment, FIG. 26 is a CIE 1931 chromaticity diagram, which is illustrated by enlarging an area A of FIG. 25, and FIG. 27 is a view illustrating an example of a color control on the CIE 1931 chromaticity diagram of FIG. 26 in the lighting apparatus according to an embodiment.

Referring to FIG. 23, a lighting apparatus includes a light-emitting module 100 according to an embodiment, a control unit 510 controlling the light-emitting module 100, a memory unit 520 in which control information of the light-emitting module 100 is stored, and a driver 530 controlling driving of the light-emitting module 100.

The light-emitting module 100 includes a light source part 4 according to an embodiment and a heat detection device 5 disposed outside the light source part 4.

Referring to the light source part described with reference to FIGS. 1 to 18, the light source part 4 may include a first light source part 4A including a plurality of first light emitting devices 1A to 1E, a second light source part 4B including a plurality of second light emitting devices 2A to 2D, and a second light source part 4C including a plurality of third light emitting devices 3A and 3B.

The reflection member 65 described with reference to FIGS. 8 to 16 may be disposed around the light source part 4, and the optical sheet (see reference numeral 69 of FIG. 18), e.g., a diffusion sheet may be disposed on the light source part 4. Light emitted from the light source part 4 may be mixed to emit white light, reflected by the reflection member 65, and mixed in a mixing space within the reflection member 65 and then emitted to the outside through the optical sheet 69.

A correlated color temperature (CCT) of light emitted from the light-emitting module 100 according to an embodiment may range from 2,700 K to 6,500 K. Also, a CRI of the light emitted from the light-emitting module 100 according to an embodiment may be 88 or more, e.g., 90 or more. When the CRI is 90 or more, the CCT of the light emitted from the light-emitting module according to an embodiment may range from 2,700 K to 5,700 K.

The first light source part 4A of the light-emitting module 100 may be driven by a first current signal $I_R$ of a first driving part 531 of the driver 530, the second light source part 4B may be driven by a second current signal $I_G$ of a second driving part 532 of the driver 530, and the third light source part 4C may be driven by a third current signal $I_B$ of a third driving part 533 of the driver 530. In the light-emitting module 100, the first to third light source parts 4A, 4B, and 4C may be driven by the first to third current signals IR, IG, and IB of the driver 530. The light-emitting module 100 may emit white light having a preset CCT by the driven first to third light source parts 4A, 4B, and 4C.

The control unit 510 may control the light-emitting module to transmit first to third current control signals $D_R$, $D_G$, and $D_B$ to the first to third driving parts 531, 532, and 533 of the driver 530 so that the white light emitted from the light source part 4 becomes the white light having the preset CCT.

The first to third current control signals $D_R$, $D_G$, and $D_B$ may be input current strength values with respect to the first to third light source parts 4A, 4B, and 4C so that the white light having the preset CCT is emitted. Each of the first to third current control signals $D_R$, $D_G$, and $D_B$ may be a pulse width modulation (PWM) signal, an amplitude modulation signal, or an analog signal. In this embodiment, the first to third current control signals $D_R$, $D_G$, and $D_B$ will be described as the PWM signal.

The first to third driving parts 531, 532, and 533 of the driver 530 generate driving current corresponding to the first to third current control signals $D_R$, $D_G$, and $D_B$ of the control unit 510, for example, the PWM signals to output the driving current to the first to third light source parts 4A, 4B, and 4C. That is, the driver 530 generates drive current having different current strengths for each time period to produce a natural light atmosphere in the morning, lunch or evening time.

Compensation data 521 and a look up table 522 are stored in the memory unit 520. The memory unit 520 may be an electrically erasable programmable read-only memory (EEPROM).

The compensation data 521 may be input current strength values that are light characteristics for each light emitting module, for example, chromaticity coordinates which become a reference for each preset CCT for the white light emitted from each of the light-emitting modules 100.

The input current strength values of the first to third light source parts 4A, 4B, and 4C are stored in the look up table 522 so that the white light having a preset CCT for each temperature detected from the light-emitting module 100 is emitted.

The control unit 510 outputs the first to third current control signals $D_R$, $D_G$, and $D_B$ corresponding to the input current strength values of the first to third light source parts 4A, 4B, and 4C to the driver 530 so as to compensate or emit the white light that becomes the reference for each preset CCT with reference to the compensation data 521 of the memory unit 520.

The control unit 510 may generate the first to third current control signals $D_R$, $D_G$, and $D_B$ that are the input current strength values corresponding to the preset CCT with reference to the look up table 522 of the memory unit 520 to output the generated control signals to the first to third driving parts 531, 532, and 533.

A ratio of reference current values corresponding to a CCT required according to an operation mode or user's selection is previously stored in the look up table 522. The ratio of the reference values may be previously measured test data.

For another example, an input current strength value that is capable of compensating a chromaticity change according to temperature characteristics for each light-emitting module 100 may be stored in the look up table 522. That is, input current strength values for compensating the white light emitted from the first to third light source parts 4A, 4B, and 4C with the white light that becomes the reference for each preset CCT according to a temperature change may be stored in the look up table 522.

The color coordinates of the white light emitted from the light emitting module 100 may move as a temperature increases. Thus, the control unit 510 detects the input current values according to the temperature data detected from the heat detection device 5 of the light emitting module 100 with reference to the look up table 522 of the memory unit 520 to transmit the first to third current control signals $D_R$, $D_G$, and $D_B$ to the driver 530.

Here, as the color coordinates move according to the temperature, the control unit 510 may control the white light emitted from the light-emitting module 100 with reference to the look up table 522 with reference to the look up table 522 and the compensation data 521 for each CCT of the white light to emit the white light having the preset CCT value.

When explaining a lighting control method of the lighting apparatus according to an embodiment with reference to FIGS. 24 and 23, the compensation data for each light-emitting module according to an embodiment may be obtained. For this, the light-emitting module 100 may be driven by an input current value according to a predetermined CCT so as to previously set the light-emitting module 100 when the light-emitting module 100 is manufactured (S1), and thus chromaticity data corresponding to luminous flux of red, green, and blue light emitted from the driven light-emitting module 100 may be detected. A deviation value between the detected chromaticity data of the CCT and the reference chromaticity data for each CCT may be calculated (S2), and the compensated value of the calculated deviation value may become the compensation data 521.

The compensation data 521 may become an input current value that compensates for a difference between the reference chromaticity data for each CCT and the chromaticity data detected from the light emitting module 100. In the embodiment, when the light emitting module 100 is set, deviation of the chromaticity data for each CCT according to luminous flux characteristics of different light emitting modules 100 may be previously detected, and the compensation data 521 that compensates for the chromaticity data may be stored in the memory unit 520 (S3).

For example, as illustrated in FIG. 27, when the chromaticity coordinate by the luminous flux emitted from the light emitting module 100 at a predetermined CCT, for example, 2,700 K, is detected as a second coordinate value T1, and the reference chromaticity coordinate has the first coordinate value T1, the input current strength value of the chromaticity data may be adjusted so that a second coordinate value T2 removes the deviation of the first coordinate value T1. Here, the input current strength value may be adjusted by adding or subtracting a ratio of the input current and a peak value of the input current. When the chromaticity coordinates at which the second coordinate value T2 as a reference of a predetermined CCT moves to the first coordinate value T1 are detected after the adjustment process, the input current strength value may be stored in the compensation data 521 for each CCT, at which the white light corresponding to the CCT is capable of being emitted.

When the compensation data 521 is stored in the memory unit 520, the control unit 510 controls driving according to the input current strength value of the light-emitting module 100 on the basis of the compensation data 521 (S4).

Thereafter, the control unit 510 loads the input current value corresponding to the detected temperature with reference to the look up table 522 when the temperature is detected from the heat detection device 5 (S5), and then, the input current value of the light emitting module 100 may be adjusted in the compensation data for each CCT to move to the reference white light for each CCT (see reference symbol M2 of FIG. 27) by using the look up table 522 and the compensation data 521 (S6).

The control unit 510 according to an embodiment may control the white light having the preset CCT value so that the white light is emitted with reference to the look up table according to the temperature change and the compensation data by the white light emitted from the light emitting module 100.

Referring to FIG. 26, since a color temperature of light that is capable of being emitted by the lighting apparatus according to an embodiment is located on a black body locus or very close to the black body locus like "CCT Tunable", and located at an Ansi center or very close to the Ansi center, the CRI may be very high. Also, the chromaticity value of the light emitted from the light emitting module 100 may be emitted as white light existing in a limited area of the black body locus on the CIE-1931 chart.

Also, as the first to third light source parts 4A, 4B, and 4C that emit red, green, and blue light are combined with each other, it is confirmed that the white light capable of maintaining a CRI of 90 or more, preferably, 95 is capable of being realized, and it is confirmed that the white light having CCT in the range of 3,500 K to 6,500K is capable of being realized.

The light emitting module and/or the lighting apparatus having the same according to the embodiments include devices such as an interior lamp, an outdoor lamp, a street lamp, a vehicle lamp, a headlight or a tail lamp of a movable or fixed device, and an indicator lamp.

The light emitting module and/or the lighting apparatus having the same according to the embodiments may be applied to display devices. Such a display device may be provided as a module or unit for irradiating light from a rear side of a panel, like a liquid crystal display panel.

Features, structures, and effects described in the above embodiments are incorporated into at least one embodiment, but are not limited to only one embodiment. Moreover, features, structures, and effects exemplified in one embodiment can easily be combined and modified for another embodiment by those skilled in the art. Therefore, these combinations and modifications should be construed as falling within the scope of the present invention.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

INDUSTRIAL APPLICABILITY

In the embodiments, the light-emitting module may be improved in color uniformity.

In the embodiments, the light-emitting module may be improved in heat dissipation efficiency.

In the embodiments, the light emitting devices emitting different colors may be optimally arranged to reduce sizes of the circuit board and the light-emitting module having the same.

The invention claimed is:

1. A lighting apparatus comprising:

a light-emitting module comprising a circuit board and a light source part disposed on the circuit board and comprising first to third light source parts emitting red, green and blue light;

a control unit providing first to third current control signals to control current of each of the first to third light source parts;

a driver adjusting the current of the first to third light source parts through the first to third current control signals of the control unit; and a memory unit having compensation data in which input current strength values for the first to third light source parts are stored so that white light having a preset correlated color temperature (CCT) is emitted from the first to third light source parts, wherein the first light source part comprises a plurality of first light emitting devices emitting red light, the second light source part comprises a plurality of second light emitting devices emitting green light, the third light source part comprises a plurality of third light emitting devices emitting blue light, and the control unit controls the current of the first to third light source parts through the input current strength values corresponding to the compensation data to control the light-emitting module so that the white light emitted from the light-emitting module is emitted as white light that becomes a reference for each CCT, wherein the circuit board comprises a first wiring portion disposed under the plurality of first light emitting devices, a second wiring portion disposed under the plurality of second light emitting devices, and a third wiring portion disposed under the plurality of third light emitting devices, and wherein the first wiring portion comprises a plurality of wirings, and each of the plurality of wirings has a top surface area greater than that of each of wirings of the second and third wiring portions.

2. The lighting apparatus according to claim 1, wherein the memory unit comprises a look up table in which the input current strength values for compensating the white light emitted from the first to third light source parts to white light that becomes the reference for each preset CCT according to a temperature change.

3. The lighting apparatus according to claim 2, wherein the light-emitting module comprises a heat detection device disposed outside the first light emitting device, and the control unit transmits the first to third current control signals to the driver through the input current strength values of the look up table according to a temperature transmitted from the heat detection device.

4. The lighting apparatus according to claim 1, wherein the first to third light emitting devices are disposed on the circuit board, the plurality of first light emitting devices are disposed around an outside of the second and third light emitting devices, the plurality of second light emitting devices are disposed on both sides of the plurality of third light emitting devices, the plurality of first light emitting devices are connected to each other in series, the plurality of second light emitting devices are connected to each other in series, the plurality of third light emitting devices are connected to each other in series, and a number of first to third light emitting devices are different from each other.

5. The lighting apparatus according to claim 1, wherein a number of each of the first to third light emitting devices increases as a wavelength of the emitted light increases.

6. The lighting apparatus according to claim 1, further comprising a reflection member disposed around each of the light source parts on the circuit board, and wherein the plurality of first light emitting devices are disposed more adjacent to the reflection member than the second and third light emitting devices.

7. The lighting apparatus according to claim 1, wherein a number of plurality of first light emitting devices is greater than that of plurality of second light emitting devices, and a number of plurality of second light emitting devices is greater than that of plurality of third light emitting devices.

8. The lighting apparatus according to claim 1, wherein a number of second light emitting devices corresponds to 200% of a number of third light emitting devices, and a number of first light emitting devices corresponds to 125% of the number of second light emitting devices.

9. The lighting apparatus according to claim 1, wherein the plurality of second light emitting devices are disposed inside a virtual circle passing through the plurality of first light emitting devices by using an area between the plurality of third light emitting devices as a center, and the plurality of third light emitting devices are disposed inside a virtual circle passing through the plurality of second light emitting devices by using the area between the plurality of third light emitting devices as a center.

10. The lighting apparatus according to claim 7, wherein output-sides of the plurality of first light emitting devices are connected to input-sides of the plurality of second light emitting devices, and output-sides of the plurality of second light emitting devices are connected to input-sides of the plurality of third light emitting devices.

11. The lighting apparatus according to claim 6, wherein a plurality of holes to which a lower portion of the reflection member is coupled are defined in the circuit board, and the plurality of holes are defined outside a virtual circle passing through the plurality of first light emitting devices.

12. The lighting apparatus according to claim 11, further comprising a light transmissive member in the reflection member, wherein the reflection member has a lower diameter greater than an upper diameter thereof, and the reflection member has a height greater than the lower diameter.

13. A lighting apparatus comprising:

a light-emitting module comprising a circuit board and a light source part disposed on the circuit board and comprising first to third light source parts emitting red, green and blue light;

a control unit providing first to third current control signals to control current of each of the first to third light source parts;

a driver adjusting the current of the first to third light source parts through the first to third current control signals of the control unit;

a memory unit having compensation data in which input current strength values for the first to third light source parts are stored so that white light having a preset correlated color temperature (CCT) is emitted from the first to third light source parts;

a reflection member disposed around each of the light source parts on the circuit board, and wherein the plurality of first light emitting devices are disposed more adjacent to the reflection member than the second and third light emitting devices;

wherein a plurality of holes to which a lower portion of the reflection member is coupled are defined in the circuit board, and the plurality of holes are defined outside a virtual circle passing through the plurality of first light emitting devices wherein the first light source part comprises a plurality of first light emitting devices emitting red light, the second light source part comprises a plurality of second light emitting devices emitting green light, the third light source part comprises a plurality of third light emitting devices emitting blue light, and the control unit controls the current of the first to third light source parts through the input current strength values corresponding to the compensation data to control the light-emitting module so that the white light emitted from the light-emitting module is emitted as white light that becomes a reference for each CCT, further comprising a plurality of support protrusions disposed in the reflection member and protruded from the first wiring portion.

14. The lighting apparatus according to claim 13, wherein the circuit board comprises a first wiring portion disposed under the plurality of first light emitting devices, a second wiring portion disposed under the plurality of second light emitting devices, and a third wiring portion disposed under the plurality of third light emitting devices, and the first wiring portion comprises a plurality of wirings, and each of the plurality of wirings has a top surface area greater than that of each of wirings of the second and third wiring portions, wherein each of the support protrusions is made of a metal material, and at least one support protrusion protrudes from at least one wiring of the wirings of the first wiring portion.

15. The lighting apparatus according to claim 13, wherein the reflection member has a lower diameter greater than an upper diameter thereof, and the reflection member has a height greater than the lower diameter.

16. The lighting apparatus according to claim 13, wherein the memory unit comprises a look up table in which the input current strength values for compensating the white light emitted from the first to third light source parts to white light that becomes the reference for each preset CCT according to a temperature change.

17. The lighting apparatus according to claim 16, wherein the light-emitting module comprises a heat detection device disposed outside the first light emitting device, and the control unit transmits the first to third current control signals to the driver through the input current strength values of the look up table according to a temperature transmitted from the heat detection device.

18. The lighting apparatus according to claim 13, wherein the first to third light emitting devices are disposed on the circuit board, the plurality of first light emitting devices are disposed around an outside of the second and third light emitting devices, the plurality of second light emitting devices are disposed on both sides of the plurality of third light emitting devices, the plurality of first light emitting devices are connected to each other in series, the plurality of second light emitting devices are connected to each other in series, the plurality of third light emitting devices are connected to each other in series, and a number of first to third light emitting devices are different from each other.

19. The lighting apparatus according to claim 13, wherein the plurality of second light emitting devices are disposed inside a virtual circle passing through the plurality of first light emitting devices by using an area between the plurality of third light emitting devices as a center, and the plurality of third light emitting devices are disposed inside a virtual circle passing through the plurality of second light emitting devices by using the area between the plurality of third light emitting devices as a center.

20. The lighting apparatus according to claim 19, wherein output-sides of the plurality of first light emitting devices are connected to input-sides of the plurality of second light emitting devices, and output-sides of the plurality of second light emitting devices are connected to input-sides of the plurality of third light emitting devices.

* * * * *